US007627277B2

(12) United States Patent
Maeda

(10) Patent No.: US 7,627,277 B2
(45) Date of Patent: Dec. 1, 2009

(54) IMAGE FORMING APPARATUS AND IMAGE FORMING METHOD

(75) Inventor: Katsuhiko Maeda, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 223 days.

(21) Appl. No.: 11/688,122

(22) Filed: Mar. 19, 2007

(65) Prior Publication Data

US 2007/0217831 A1 Sep. 20, 2007

(30) Foreign Application Priority Data

Mar. 17, 2006 (JP) ..... 2006-075472

(51) Int. Cl.
*G03G 15/01* (2006.01)

(52) U.S. Cl. ..... 399/301; 399/40

(58) Field of Classification Search ..... 399/40, 399/41, 301

See application file for complete search history.

(56) References Cited

U.S. PATENT DOCUMENTS

2004/0160506 A1 8/2004 Maeda
2004/0239747 A1 12/2004 Maeda
2005/0200689 A1 * 9/2005 Shinohara et al. ..... 347/116

FOREIGN PATENT DOCUMENTS

| | | |
|---|---|---|
| EP | 1 575 258 A2 | 9/2005 |
| JP | 10-044502 | 2/1998 |
| JP | 2000-112205 | 4/2000 |
| JP | 2004-295083 | 10/2004 |

OTHER PUBLICATIONS

U.S. Appl. No. 12/107,387, filed Apr. 22, 2008, Maeda.

* cited by examiner

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

An image forming apparatus, including a compensation pattern forming device to form a predetermined compensation pattern to compensate image displacement in each key color, a plurality of detectors to detect two key colors in the predetermined compensation pattern, and a compensating device to compensate the image displacement of the two key colors detected by the detectors.

19 Claims, 17 Drawing Sheets

IMAGE FORMING APPARATUS AND IMAGE FORMING METHOD

PRIORITY STATEMENT

The present patent application claims priority under 35 U.S.C. §119 upon Japanese patent application No. 2006-075472, filed in the Japan Patent Office on Mar. 17, 2006, the content and disclosure of which is hereby incorporated by reference herein in its entirety.

BACKGROUND

1. Field of the Invention

Exemplary embodiments of the present invention generally relate to an image forming apparatus and an image forming method capable of controlling position of the image at the time of forming image of a plurality of colors.

2. Discussion of the Background

In a background color image forming apparatus, the color image is formed by piling up images of a plurality of key colors. If the image position of each key color shifts, the color of a line drawing or a character can change, or image unevenness (uneven coloring) can occur, and the image quality can be decreased. Therefore, it is necessary to ensure that the image position of each key color is accurate.

A background color image forming apparatus compensates for the displacement between the key colors generated according to various factors, such as change of environmental temperature and change of inside temperature.

For example, a background color image forming apparatus compensates for the displacement by detecting the inclination of a pattern for compensation formed on a transfer belt.

However, in a background color image forming apparatus, since there are many patterns for compensation formed on a transfer belt and detected by one sensor, it can take a long time for the compensation to be completed. Thus, it is desirable to reduce waiting time for a user, and it is desirable to reduce the decline of the average print speed.

In a background color image forming apparatus, during sequential printing, the apparatus forms the patterns for compensation on the transfer belt and compensates for any image displacement. It is necessary to form the patterns between print images (between sheets). Therefore, the domain of forming patterns is restricted. Extending the domain between sheets results in a large area for many pattern formations, but the print speed may be reduced.

SUMMARY

An exemplary embodiment of the present invention is directed to an image forming apparatus and an image forming method to form an image using a plurality of colors capable of controlling position of the image. In example embodiments, an image forming apparatus may include a compensation pattern forming device configured to form a predetermined compensation pattern to compensate image displacement in each key color, a plurality of detectors configured to detect two key colors in the predetermined compensation pattern, and a compensating device configured to compensate the image displacement of the two key colors detected by the detectors. A method for image forming may include the steps of forming a predetermined compensation pattern to compensate image displacement in each key color, detecting two key colors in the predetermined compensation pattern, and compensating the image displacement of the two key colors detected by the detectors.

Additional features and advantages of the present invention will be more fully apparent from the following detailed description of exemplary embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
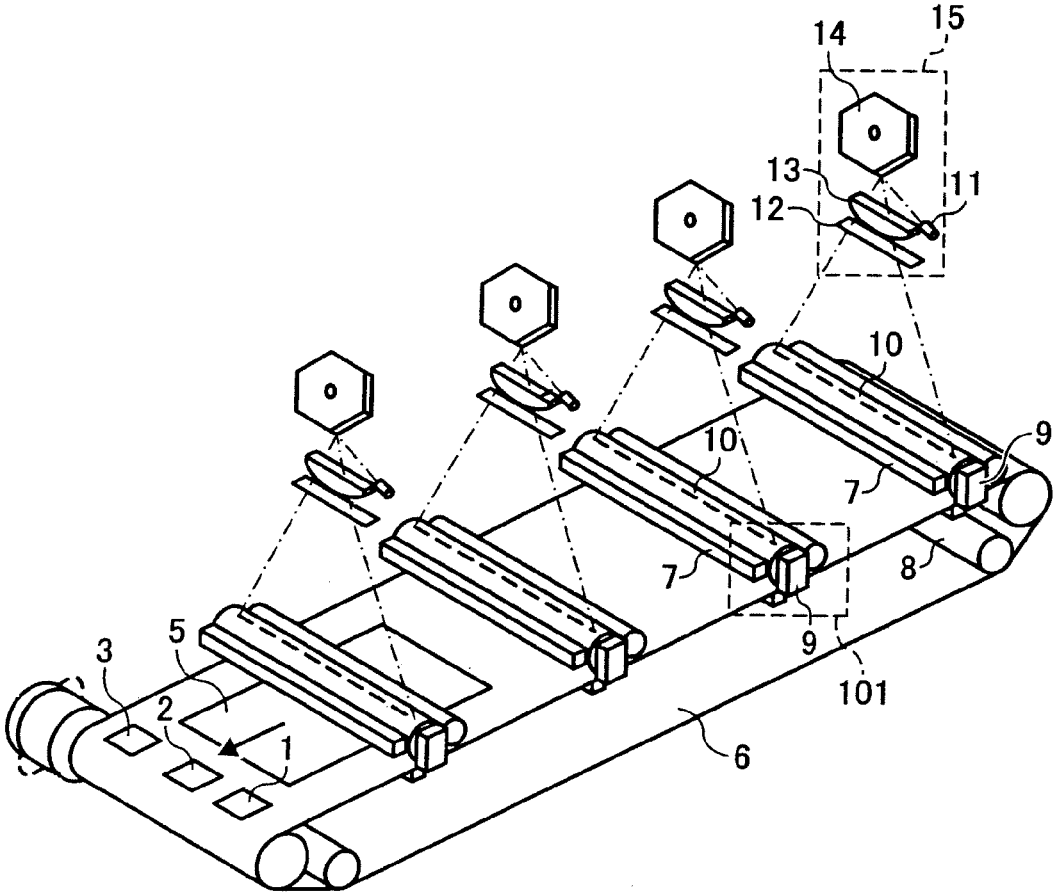
FIG. 1 is a perspective diagram illustrating a four-drum type color image forming apparatus according to an exemplary embodiment of the present invention.

It will be understood that if an element or layer is referred to as being "on," "against," "connected to," or "coupled to" another element or layer, then it can be directly on, against, connected, or coupled to the other element or layer, or intervening elements or layers may be present. In contrast, if an element is referred to as being "directly on," "directly connected to," or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers, and/or sections, it should be understood that these elements, components, regions, layers, and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

In describing the exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an example of an image forming apparatus according to exemplary embodiments is explained.

EXAMPLE 1

FIG. 1 is a perspective diagram illustrating a four-drum type color image forming apparatus according to a first exemplary embodiment of the present invention. This image forming apparatus forms a color image by piling up four key colors i.e., yellow (Y), magenta (M), cyan (C), and black (Bk). This image forming apparatus has an image formation section 101 and an optical beam scanning device 15 for every key color. The image formation section 101 includes an electrification device 7, a transfer device 8, a development device 9, and a photoconductor 10. In addition, although not illustrated, a cleaning device and a neutralization device are also included. A person of ordinary skill in the art knows how the image formation section 101 operates, and a lengthy description is not included. In the image formation section 101, images can be formed and fixed on a recording sheet 5 using a well-known electronic photograph process. Moreover, the optical beam scanning device 15 includes an LD (laser diode) device 11, a polygon mirror 14, an Fθ lens 13, and a barrel toroidal lens (BTL) 12.

The color image can be formed on the recording sheet 5 which is conveyed in the direction of the arrow on a transfer belt 6 piling up the images of Y, M, C, and BK, one by one. The color image is fixed with the fixing device (not shown) on the recording sheet 5.

Sensors 1, 2, 3 are provided in the image forming apparatus for detecting a pattern on the transfer belt 6 for compensating the displacement.

Next, the optical beam scanning device 15 is explained. An LD in the LD device 11 is driven with the drive signal modulated based on the image data. The optical beam irradiated from the LD is parallelized by a collimator lens (not shown). This parallel beam from the LD device 11 passes a cylinder lens (not shown) and reaches the polygon mirror 14. The polygon mirror 14 is driven to rotate with a polygon motor (not shown). The beam is deflected at the polygon mirror 14, and reaches the Fθ lens 13. The optical beam from the Fθ lens 13 passes the BTL 12, and scans the surface of the photoconductor 10. The BTL 12 is provided for focusing in the sub-scanning direction. In more detail, it is provided for concentrating a beam, compensating a position in a sub-scanning direction (e.g. a correction of optical face tangle error), etc. The direction in which the optical beam scans the photoconductor is a direction from the sensor 1 to the sensor 3 shown in FIG. 1. A person of ordinary skill in the art knows how the image beam formation device operates, and a lengthy description is not included.

Figure 2:
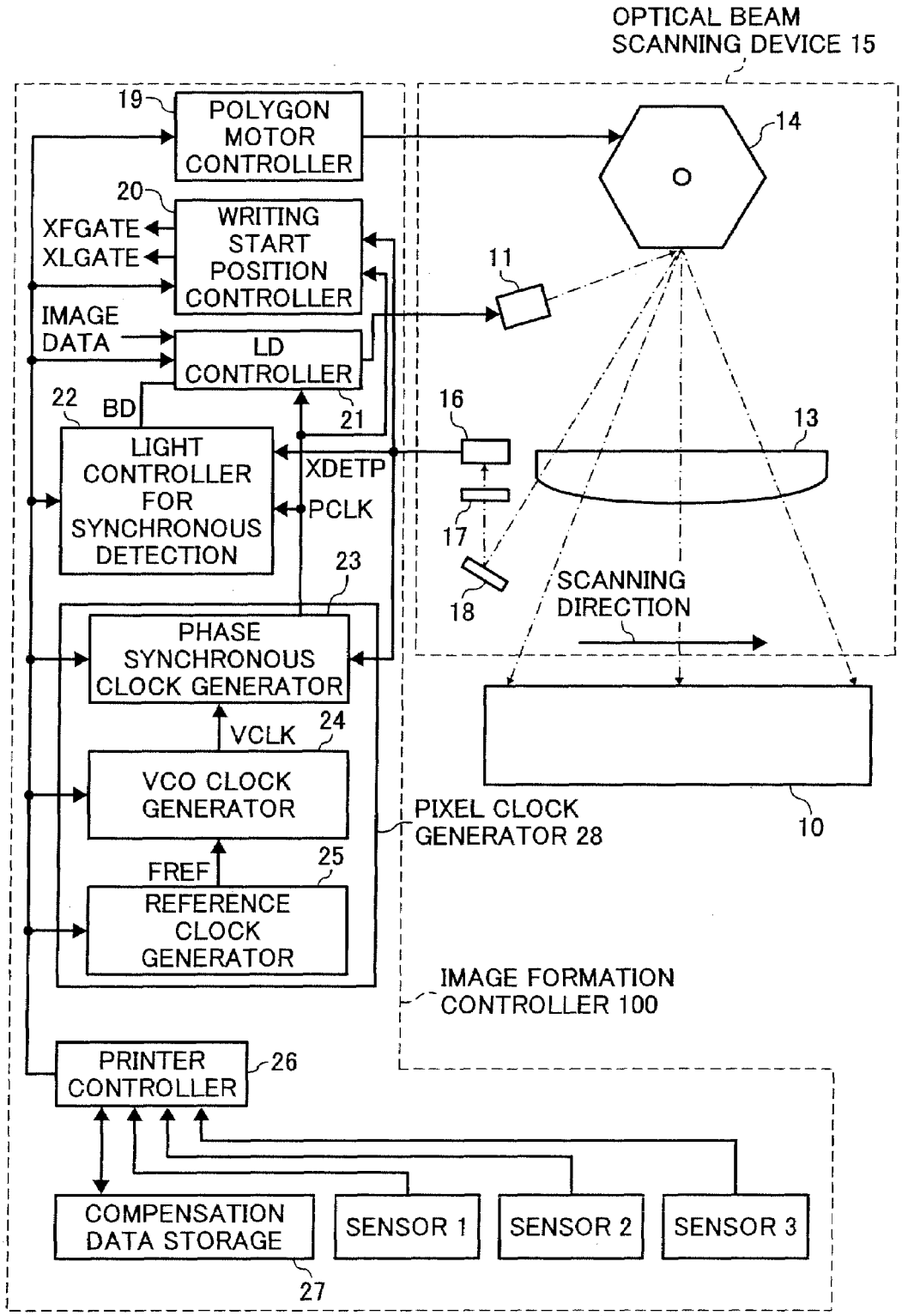
FIG. 2 is a block diagram illustrating a configuration of an image formation controller and an optical beam scanning device in the image forming apparatus of FIG. 1.

FIG. 2 is a block diagram illustrating a configuration of an image formation controller 100 and the optical beam scanning device 15 in the image forming apparatus of FIG. 1. A synchronous detection sensor 16 for detecting a beam is provided at the side of the image writing start portion in the main-scanning direction in the optical beam scanning device 15. The beam from the Fθ lens 13 is reflected by a mirror 18, and is condensed with a lens 17, and reaches the synchronous detection sensor 16.

When the beam reaches the synchronous detection sensor 16, a synchronous detection signal XDETP is output from the synchronous detection sensor 16. The XDETP is sent to a pixel clock generator 28, a light controller for synchronous detection 22, and a writing start position controller 20.

In the pixel clock generator 28, a pixel clock PCLK, which is synchronized with the synchronous detection signal XDETP, is generated. This pixel clock PCLK is sent to an LD controller 21 and the light controller for synchronous detection 22.

Figure 3:
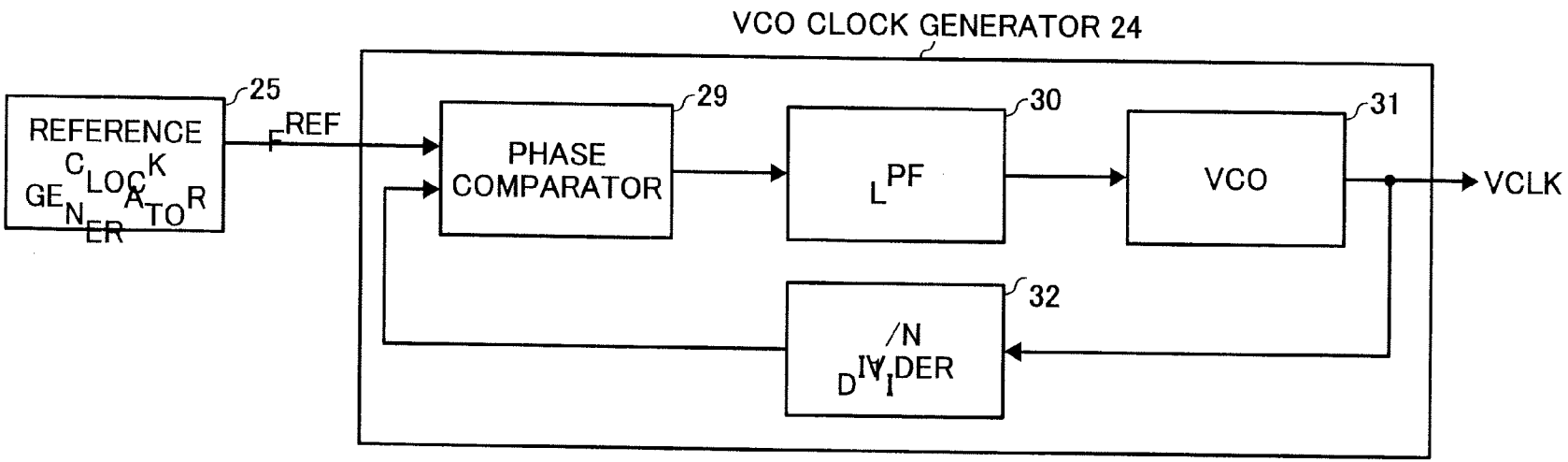
FIG. 3 is a block diagram illustrating a configuration of a reference clock generator and a VCO clock generator of FIG. 2.

The pixel clock generator 28 includes a reference clock generator 25, a VCO (Voltage Controlled Oscillator) clock generator 24, and a phase synchronous clock generator 23. FIG. 3 is a block diagram illustrating a configuration of the reference clock generator 25 and the VCO clock generator 24 of FIG. 2. As shown in FIG. 3, in the VCO clock generator 24 (PLL circuit: Phase Locked Loop), a reference clock signal FREF from the reference clock generator 25 and a divided signal from VCLK by a 1/N divider 32 are input into a phase comparator 29. With the phase comparator 29, phase comparison of the falling edge of both signals is performed, and the constant current of the error ingredient is output. An unnecessary high frequency ingredient and noise of this error ingredient are removed by an LPF (lowpass filter) 30, and are sent to a VCO 31. In the VCO 31, the oscillation frequency depending on the output of the LPF 30 is output. By changing the frequency of the FREF and a ratio N of dividing, the frequency of VCLK can be changed. As shown in FIG. 2, a printer controller 26 is connected to a polygon motor controller 19, the writing start position controller 20, the LD controller 21, the light controller for synchronous detection 22, and the pixel clock generator 28, and sends control signals to these devices.

In the phase synchronous clock generator 23, the pixel clock PCLK mentioned above is generated from the VCLK set to a frequency 8 times the frequency of the pixel clock. Therefore, the frequency of PCLK can change with the variation of the frequency of VCLK.

In order to detect the synchronous detection signal XDETP first, the light controller for synchronous detection 22 turns on a forcible lighting LD signal BD, and carries out forcible lighting of the LD. Once the synchronous detection signal XDETP is detected, the LD is made to turn on to the timing of the synchronous detection signal XDETP. The light controller for synchronous detection 22 can detect the synchronous detection signal XDETP as a degree of non-irradiate flare light by using the synchronous detection signal XDETP and the pixel clock PCLK. If the synchronous detection signal XDETP is detected, the light controller for synchronous detection 22 generates the forcible lighting LD signal BD which switches off the LD, and sends it to the LD controller 21.

The LD controller 21 controls lighting of a laser diode in the LD device 11 according to the image data synchronized with the forcible lighting signal BD for synchronous detection and the pixel clock PCLK. Then, the LD device 11 irradiates a laser beam, as mentioned above, and scans the surface of the photoconductor 10.

A polygon motor controller 19 controls a rotation of the polygon motor (not shown) at a regular number of rotations with the control signal from the printer controller 26.

The writing start position controller 20 generates a main-scanning gating signal XLGATE and a sub-scanning gating signal XFGATE which determine an image writing start timing and an image width based on the control signal from the printer controller 26, the synchronous detection signal XDETP, the pixel clock PCLK, etc.

The output of the sensors 1, 2, and 3, which detect the pattern for compensation of image displacement, is sent to the printer controller 26. The printer controller 26 calculates the amount of the displacement, and generates compensation data based on the outputs of those sensors. The compensation data is stored in a compensation data storage 27.

The data which determines the timing of the compensation data for rectifying an image displacement and a magnification displacement, i.e., the signals of XLGATE and XFGATE, and the data which determines the frequency of the pixel clock PCLK are stored in the compensation data storage 27. This data is sent to each above-mentioned controller by the directions from the printer controller 26.

Figure 4:
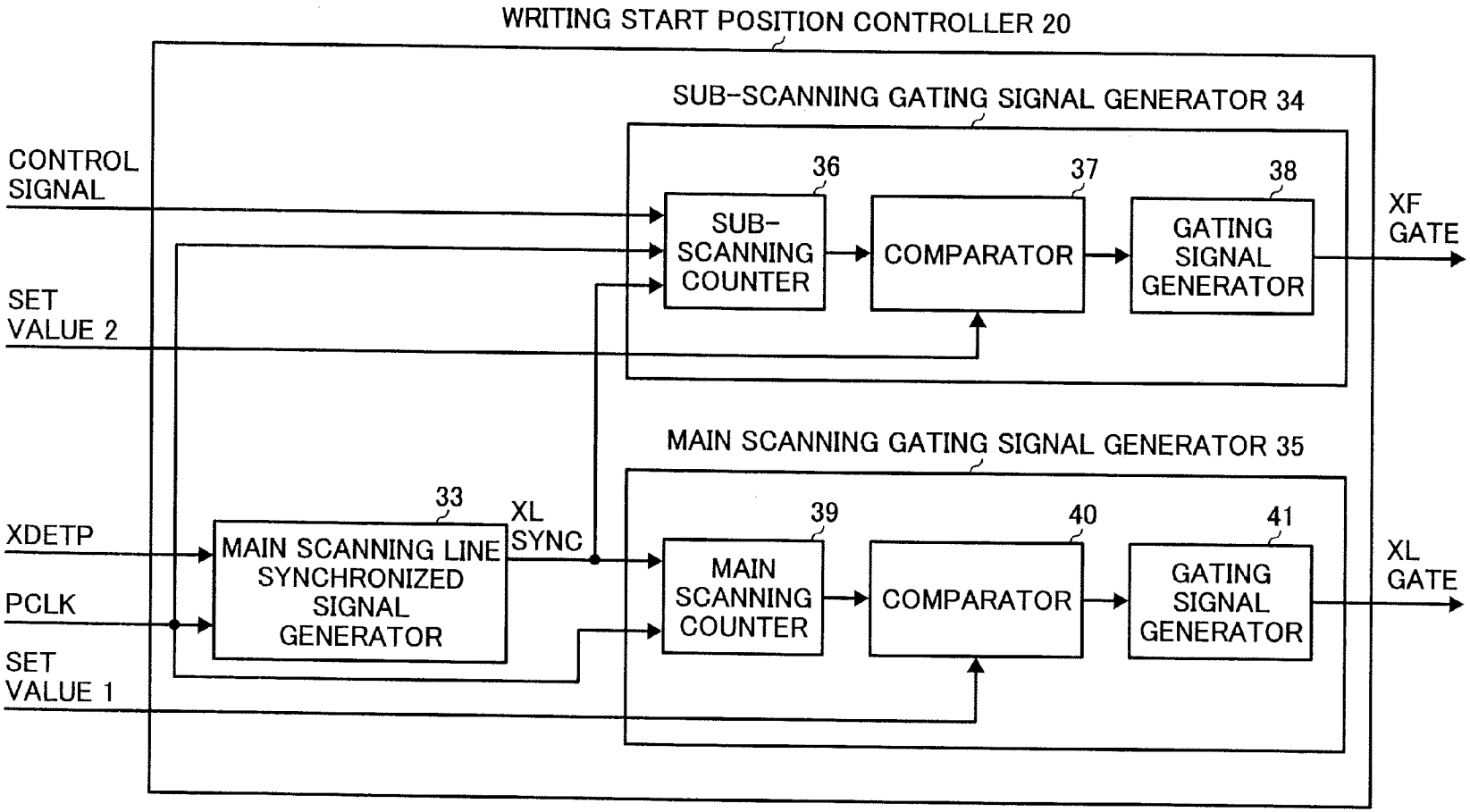
FIG. 4 is a block diagram illustrating a configuration of a writing start position controller of FIG. 2.

FIG. 4 is a block diagram illustrating a configuration of the writing start position controller 20 of FIG. 2. The writing start position controller 20 includes a main-scanning line synchronized signal generator 33, a sub-scanning gating signal generator 34, and a main-scanning gating signal generator 35. The main-scanning line synchronized signal generator 33 generates the signal XLSYNC for operating a main-scanning counter 39 in the main-scanning gating signal generator 35, and a sub-scanning counter 36 in the sub-scanning gating signal generator 34, using the signals XDETP and PCLK. The signal XLSYNC is generated by synchronizing with PCLK after the generation of the signal XDETP. The sub-scanning gating signal generator 34 generates a signal XFGATE which determines the taking-in timing (a start timing of image writing in the sub-scanning direction) of an image signal. The main-scanning gating signal generator 35 generates a signal XLGATE which determines a start timing of image writing in the main-scanning direction of an image signal.

The main-scanning gating signal generator 35 includes a main-scanning counter 39, a comparator 40, and a gating signal generator 41. The main-scanning counter 39 runs with the signals XLSYNC and PCLK. The counter value and the compensation data (a set value 1) from the printer controller 26 are compared by the comparator 40. The gating signal generator 41 generates the signal XLGATE using the comparison result of the comparator 40.

The sub-scanning gating signal generator 34 includes a sub-scanning counter 36, a comparator 37, and a gating signal generator 38. The sub-scanning counter 36 runs with the control signal from the printer controller 26 and the signals XLSYNC and PCLK. The counter value and the compensation data (a set value 2) from the printer controller 26 are compared by the comparator 37. The gating signal generator 38 generates the signal XFGATE using the comparison result of the comparator 37.

The writing start position controller 20 can compensate the writing start position with a resolution of a 1 cycle of PCLK (equal to 1 dot) in the main-scanning direction, and with a resolution of a 1 cycle of XLSYNC (equal to 1 line) in the sub-scanning direction. The compensation data of both the main-scan and the sub-scan directions are stored in the compensation data storage 27.

Figure 5:
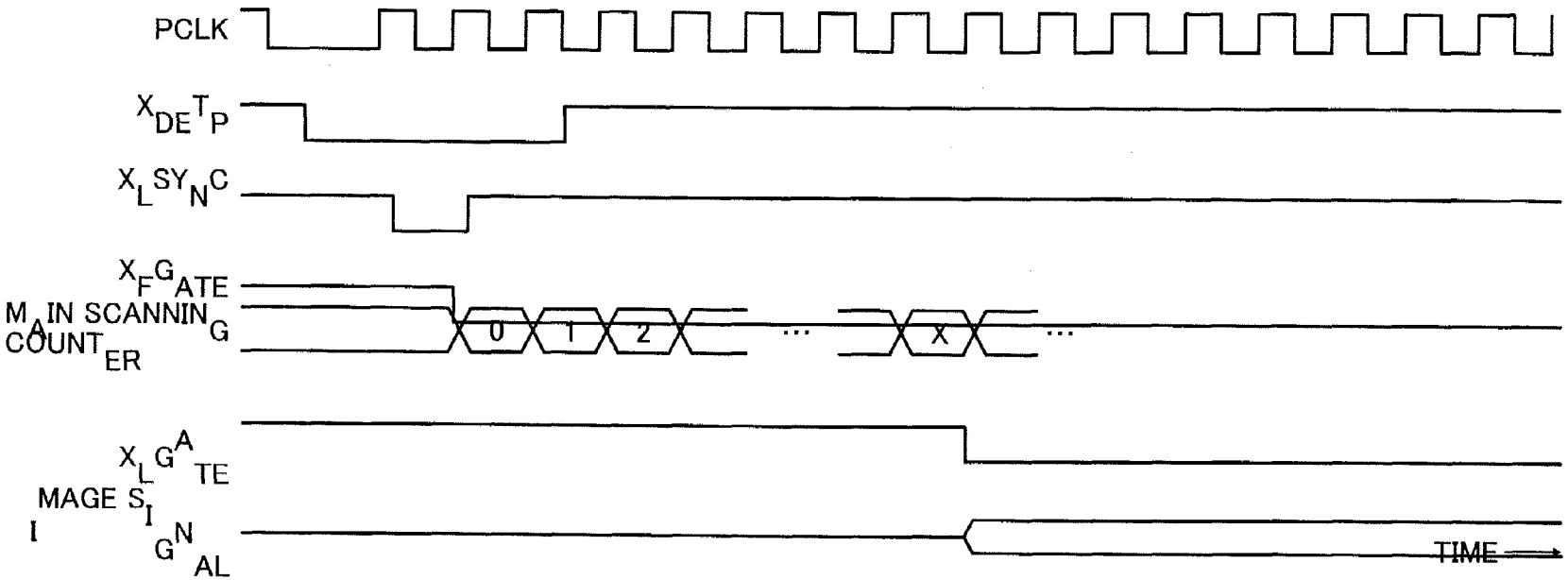
FIG. 5 is a timing chart for explaining the operation of the writing start position controller of FIG. 4.

FIG. 5 is a timing chart for explaining the operation of the writing start position controller 20 of FIG. 4. If the synchronous detection signal XDETP occurs, the timing signal XLSYNC synchronized with the pixel clock PCLK is generated. The value of the main-scanning counter 39 is reset by this XLSYNC. The value of the main-scanning counter 39 is counted up with the pixel clock PCLK. The counter value and the compensation data (set value 1) from the printer controller 26 are compared by the comparator 40. As a result of this comparison, when the value of the main-scanning counter 39 becomes equal to the set value 1 (referred to as X here), the comparator 40 makes the XLGATE go to L level. Thus, the XLGATE is a signal set to L by the image width of the main-scanning direction, and is a signal which determines the image domain of the main-scanning direction. In addition, the writing start timing signal XLSYNC is also sent to the sub-scanning gating signal generator 34.

Figure 6:
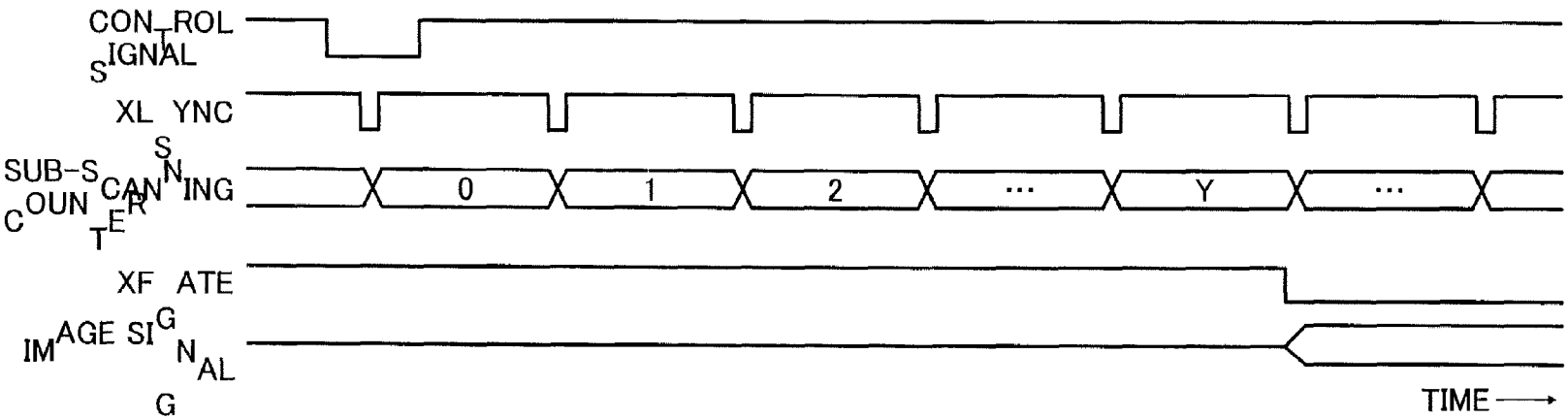
FIG. 6 is a timing chart for explaining the operation in the sub-scanning direction of the writing start position controller of FIG. 4.

FIG. 6 is a timing chart for explaining the operation in the sub-scanning direction of the writing start position controller 20 of FIG. 4. In the sub-scanning gating signal generator 34, the value of the sub-scanning counter 36 is reset by the control signal (a trigger signal of image writing) from the printer controller 26. The value of the sub-scanning counter 36 is counted up with the writing start timing signal XLSYNC. The counter value and the compensation data (set value 2) from the printer controller 26 are compared by the comparator 37. As a result of this comparison, when the value of the sub-scanning counter 36 becomes equal to the set value 2 (referred to as Y here), the comparator 38 makes the XFGATE go to L level. Thus, the XFGATE is a signal set to L by the image length of the sub-scanning direction, and is a signal which determines the image domain of the sub-scanning direction.

Figure 7:
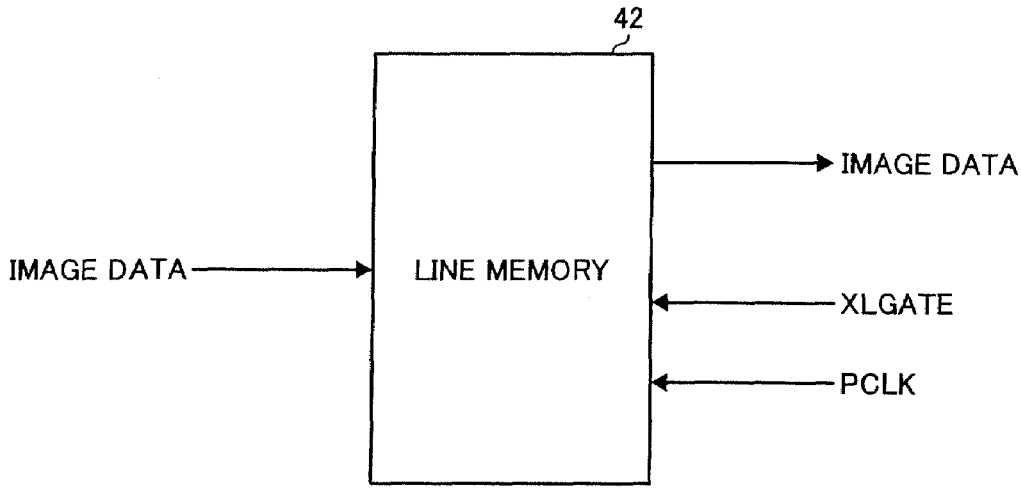
FIG. 7 is a block diagram illustrating a line memory which sends an image data to the image formation controller of FIG. 2.

FIG. 7 is a block diagram illustrating a line memory 42 which sends image data to the image formation controller 100 of FIG. 2. The line memory 42 is arranged at a position preceding the image formation controller 100. The image data sent from the further preceding printer controller, the frame memory, and the scanner (neither is illustrated) is stored in this line memory 42. This storing (image data) is performed synchronizing with XFGATE. The image data stored in the line memory 42, is read during the L of XLGATE synchronizing with the pixel clock PCLK. In this way, the read image data is sent to the LD controller 21 of the image formation controller 100.

Figure 8:
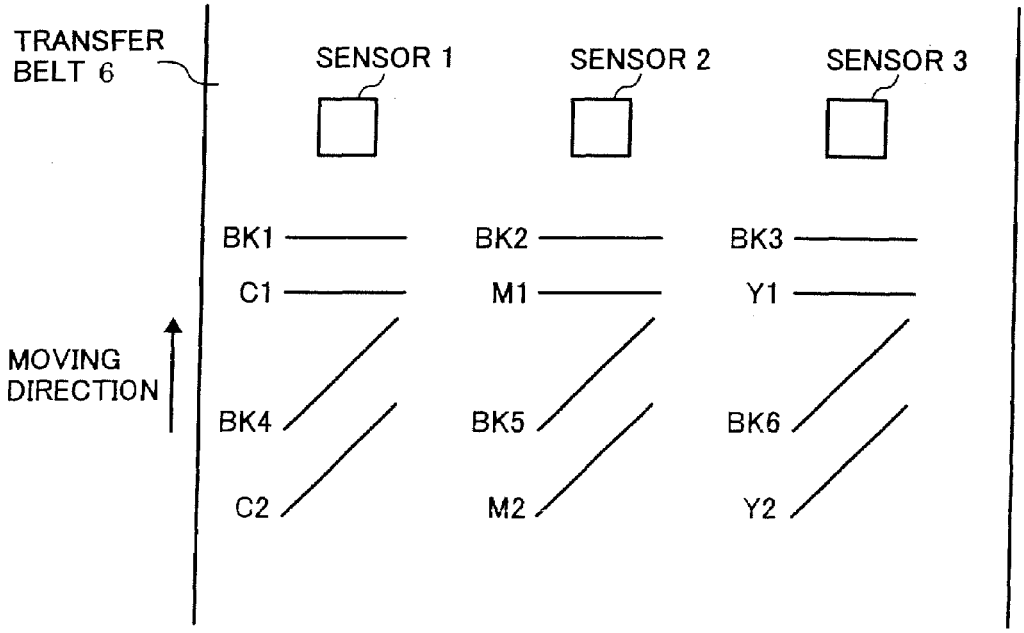
FIG. 8 is a top view illustrating a configuration of a pattern on a transfer belt for the compensation of image displacement in the image forming apparatus of FIG. 1.

FIG. 8 is a top view illustrating a configuration of a pattern on a transfer belt 6 for the compensation of image displacement in the image forming apparatus of FIG. 1. As shown in FIG. 8, horizontal lines and slanting lines are formed as patterns for image displacement compensation at predetermined timing. As for the sensor 1, Bk1 of a horizontal line pattern, C1 of a horizontal line pattern, Bk4 of a slanting line pattern, and C2 of a slanting line pattern are formed. As for the sensor 2, Bk2 of a horizontal line pattern, M1 of a horizontal line pattern, Bk5 of a slanting line pattern, and M2 of a slanting line pattern are formed. As for the sensor 3, Bk3 of a horizontal line pattern, Y1 of a horizontal line pattern, Bk6 of a slanting line pattern, and Y2 of a slanting line pattern are formed. In FIG. 8, when the transfer belt 6 moves in the direction of the arrow, the horizontal lines and the slanting lines are detected by the sensor 1, the sensor 2, and the sensor 3. The output of each sensor is sent to the printer controller 26, and the amount (time) of displacement of each color with respect to BK, which is a reference color, is calculated by the printer controller 26. Regarding the slanting line, the detection timing changes due to the displacement of the image position and the image magnification in the main-scanning direction. Regarding the horizontal line, the detection timing changes due to the displacement of the image position in the sub-scanning direction.

As for the sensor 1, regarding the image position in the main-scanning direction, it is based on a time TBK14 which is a time from detecting the pattern BK1 to detecting the pattern BK4 with the sensor 1. This time is compared with a time TC12 which is a time from detecting the pattern C1 to detecting the pattern C2. The difference TBK14-TC12 is the displacement of the cyan image with respect to the black image. In order to compensate for the displacement, the timing of the XLGATE signal is changed by a time which determines the writing start time corresponding to the difference. For example, when the TC12 is shorter than the TBK14, it is the case where the pattern C2 is shifted and formed in the left-hand side of the figure. In this case, what is necessary is just to delay the XLGATE signal corresponding to the pattern C2. On the contrary, when the TC12 is larger than the TBK14, it is the case where the pattern C2 is shifted and formed in the right-hand side of the figure. In this case, what is necessary is just to advance the XLGATE signal corresponding to the pattern C2.

As for the sensor 2, regarding the image position in the main-scanning direction, it is based on a time TBK25 which is a time from detecting the pattern BK2 to detecting the pattern BK5 with the sensor 2. This time is compared with a time TM12, which is a time from detecting the pattern M1 to detecting the pattern M2. The difference TBK25-TM12 is the displacement of the magenta image with respect to the black image. In order to compensate for the displacement, the timing of the XLGATE signal is changed by a time which determines the writing start time corresponding to the difference.

As for the sensor 3, regarding the image position of the main-scanning direction, it is based on a time TBK36, which is a time from detecting the pattern BK3 to detecting the pattern BK6 with the sensor 3. This time is compared with a time TY12, which is a time from detecting the pattern Y1 to detecting the pattern Y2. The difference TBK36-TY12 is the displacement of the yellow image with respect to the black image. In order to compensate for the displacement, the timing of the XLGATE signal is changed by a time which determines the writing start time corresponding to the difference.

Next, a compensation of the sub-scanning direction is explained. As for the sensor 1, the time difference of the C1 to the BK1 is compared with a reference value. The timing of the XFGATE signal is changed by a time which determines the writing start time corresponding to the difference according to the comparison result.

Specifically, as for the sensor 1, the time difference TBK1C1, which is a time from detecting the pattern BK1, to detecting the pattern C1 is compared with a reference value To. The difference TBK1C−To is the displacement of the cyan image with respect to the black image. In order to compensate for the displacement, the timing of the XFGATE signal is changed by a time which determines the writing start time corresponding to the difference. For example, when To is shorter than TBK1C1, the pattern C1 is shifted and formed in the top of the figure. In this case, what is necessary is to delay the XFGATE signal corresponding to the pattern C1. On the contrary, when To is larger than TBK1C1, the pattern C1 is shifted and formed in the bottom of the figure. In this case, what is necessary is just to advance the XFGATE signal corresponding to the pattern C1.

As for the sensor 2, the time difference TBK2M1, which is a time from detecting the pattern BK2 to detecting the pattern M1, is compared with a reference value To. The difference TBK2M1−To is the displacement of the magenta image with respect to the black image. In order to compensate for the displacement, the timing of the XFGATE signal is changed by a time which determines the writing start time corresponding to the difference.

As for the sensor 3, the time difference TBK3Y1, which is a time from detecting the pattern BK3 to detecting the pattern Y1, is compared with a reference value To. The difference TBK3Y1−To is the displacement of the yellow image with respect to the black image. In order to compensate for the displacement, the timing of the XFGATE signal is changed by a time which determines the writing start time corresponding to the difference.

Figure 9:
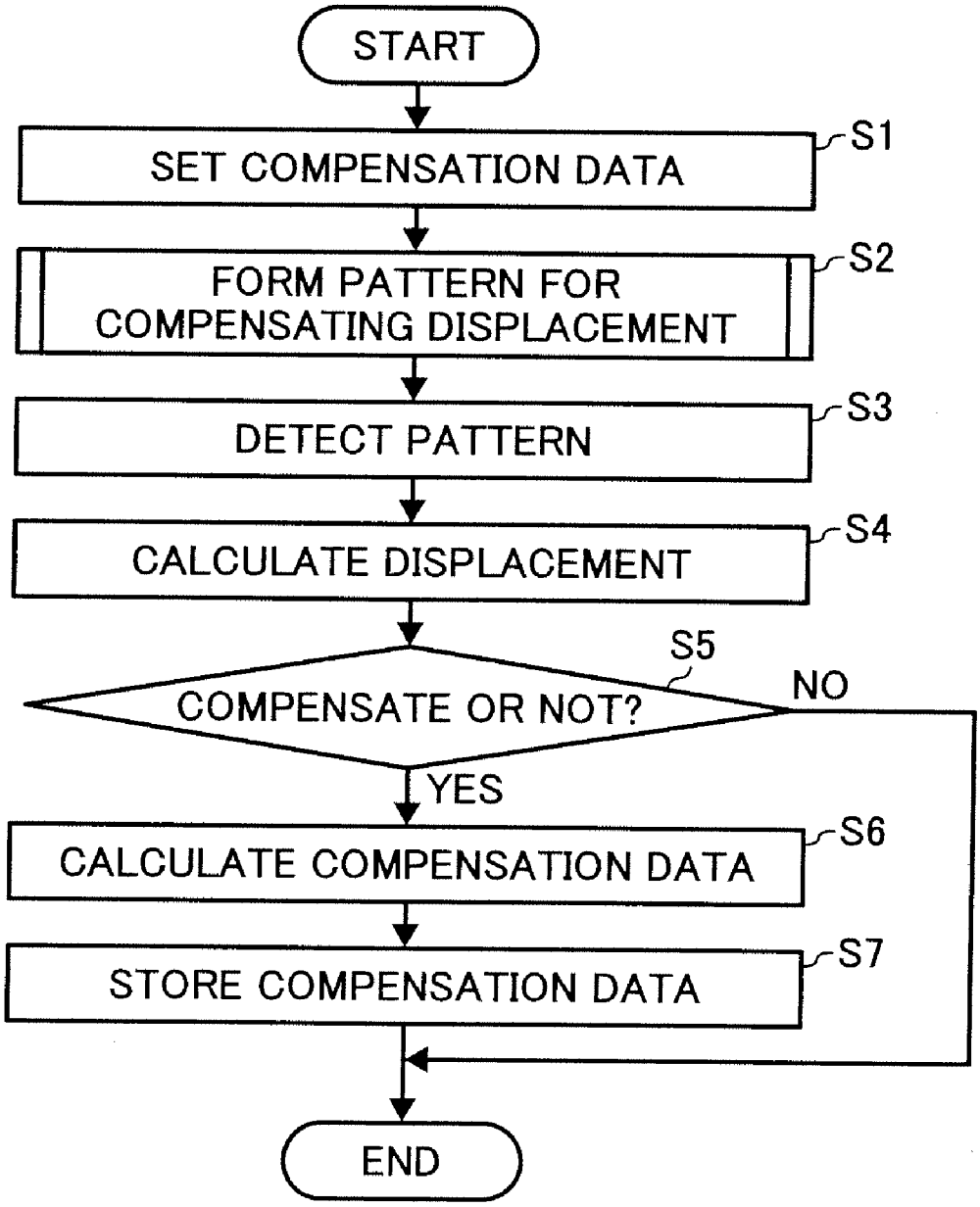
FIG. 9 is a flowchart for illustrating a flow of an operation of compensating for the displacement in FIG. 2.

FIG. 9 is a flowchart for illustrating a flow of an operation of compensating for the displacement in FIG. 2. In Step S1, the printer controller 26 reads various kinds of compensation data stored in the compensation data storage 27. The compensation data is sent to each part of the image formation controller 100. In Step S2, the printer controller 26 sends commands to the rest of the image formation control 100 and the optical beam scanning device 15, and forms the pattern for image displacement compensation shown in FIG. 8 on the transfer belt 6. In Step S3, sensor 1, sensor 2, and sensor 3 detect the pattern for image displacement compensation on the transfer belt 6. The output of each sensor is sent to the printer controller 26. In Step S4, the printer controller 26 calculates the amount of displacement of the Y, M, and C colors with respect to the reference color (in this case, the reference color is Bk). The printer controller 26 determines whether a displacement compensation of each color is performed or not in Step S5. If the amount of displacement of each color is equal or larger than ½ the resolution of the compensation, it is determined that the compensation is performed.

When it is determined that the displacement compensation is performed (YES in Step S5), the printer controller 26 calculates the amount of compensation in step S6, and stores the value in the compensation data storage 27 in Step S7. The amounts of compensation used in this step are the amount of compensation by the XLGATE signal which determines the image position of the main-scanning direction, and the amount of compensation by the XFGATE signal which determines the image position of the subs-canning direction. This flow is ended when it is determined that the printer controller 26 does not perform the displacement compensation (NO in Step S5).

After the end of the above image displacement compensation operation, when performing image formation, the printer controller 26 sets the above-mentioned compensation data stored in the compensation data storage 27 at each control part, and carries out image formation.

Although the patterns for the image displacement compensation of the horizontal line and the slanting line are used in this example, a pattern for the image displacement compensation is not restricted to these.

As explained above, since each sensor detects only the pattern of the reference color and one other color, according to the image forming apparatus and the image formation method, detection time can be reduced.

EXAMPLE 2

Next, a second exemplary embodiment of the present invention is explained. In this example, the composition of the image forming apparatus, the optical beam scanning device, and the image formation controller are the same as described above with respect to example 1.

Figure 10:
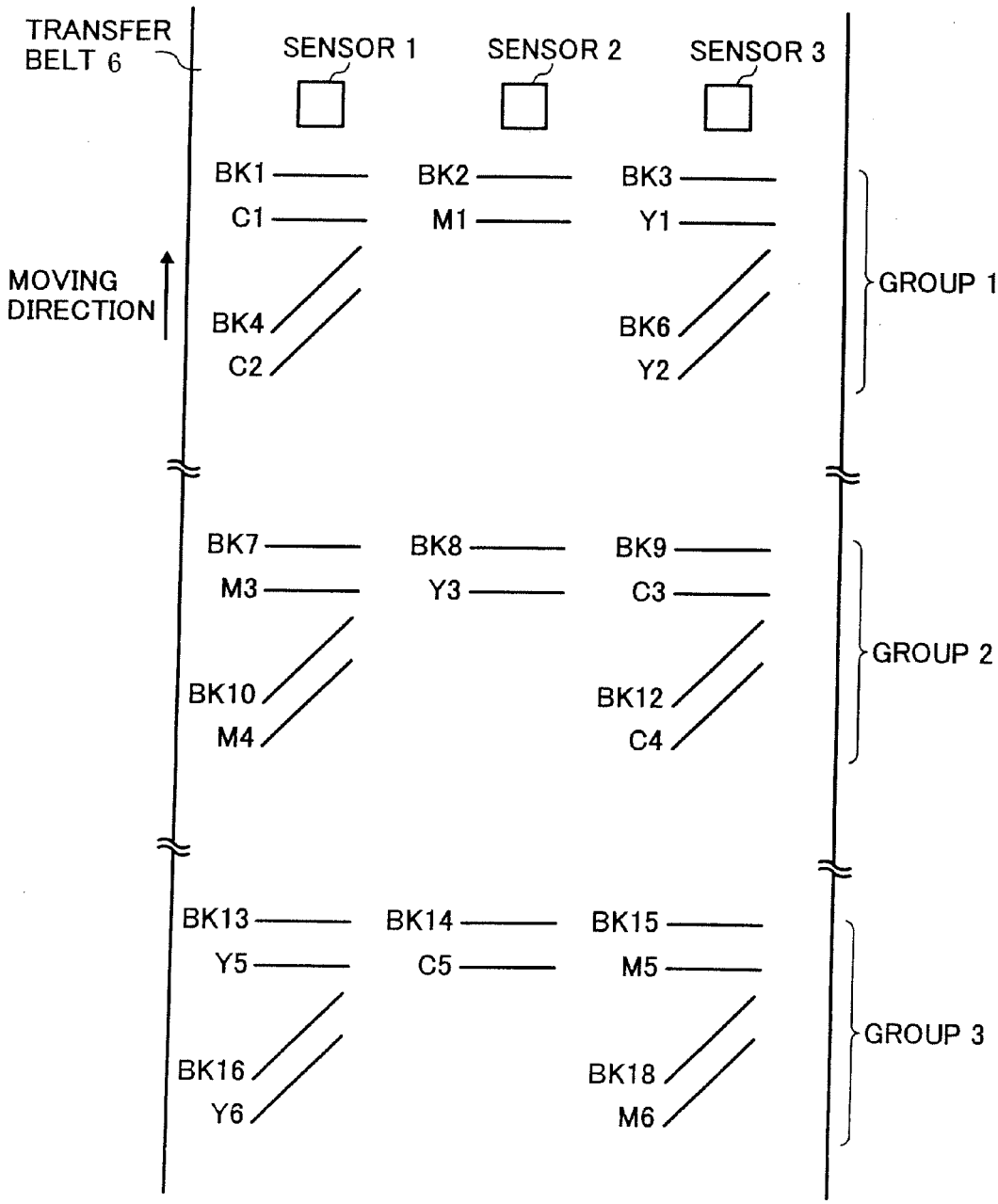
FIG. 10 is a top view illustrating a configuration of a pattern on a transfer belt for the compensation of image displacement in the second example of the image forming apparatus of FIG. 1.

FIG. 10 is a top view illustrating a configuration of a pattern on a transfer belt 6 for the compensation of image displacement in the second example of the image forming apparatus of FIG. 1. The detection of the amount of displacement using this pattern and the technique of the displacement compensation are the same as in the first example. In FIG. 10, the patterns of three groups called Group 1, Group 2, and Group 3 are formed on the transfer belt 6.

In the part of Group 1 to be read by the sensor 1, Bk1 of a horizontal line pattern, C1 of a horizontal line pattern, Bk4 of a slanting line pattern, and C2 of a slanting line pattern are formed. As for the part of Group 1 to be read by the sensor 2, Bk2 of a horizontal line pattern, and M1 of a horizontal line pattern are formed. A slanting line pattern is not formed for the sensor 2. As for the part of Group 1 to be read by the sensor 3, Bk3 of a horizontal line pattern, Y1 of a horizontal line pattern, Bk6 of a slanting line pattern, and Y2 of a slanting line pattern are formed.

In the part of Group 2 to be read by the sensor 1, Bk7 of a horizontal line pattern, M3 of a horizontal line pattern, Bk10 of a slanting line pattern, and M4 of a slanting line pattern are formed. As for the part of Group 2 to be read by the sensor 2, Bk8 of a horizontal line pattern, and Y3 of a horizontal line pattern are formed. A slanting line pattern is not formed for the sensor 2. As for the part of Group 2 to be read by the sensor 3, Bk9 of a horizontal line pattern, C3 of a horizontal line pattern, Bk12 of a slanting line pattern, and C4 of a slanting line pattern are formed.

In the part of Group 3 to be read by the sensor 1, Bk13 of a horizontal line pattern, Y5 of a horizontal line pattern, Bk1G of a slanting line pattern, and Y6 of a slanting line pattern are formed. As for part of Group 3 to be read by the sensor 2, Bk14 of a horizontal line pattern, and C5 of a horizontal line pattern are formed. A slanting line pattern is not formed for the sensor 2. As for the part of Group 3 to be read by the sensor 3, Bk15 of a horizontal line pattern, M5 of a horizontal line pattern, Bk18 of a slanting line pattern, and M6 of a slanting line pattern are formed.

In Group 1, the sensor 1 detects a displacement of the cyan image with respect to Bk as the reference color, the sensor 2 detects a displacement of the magenta image, and the sensor 3 detects a displacement of the yellow image. In Group 2, the sensor 1 detects a displacement of the magenta image, the sensor 2 detects a displacement of the yellow image, and the sensor 3 detects a displacement of the cyan image. In Group 3, the sensor 1 detects a displacement of the yellow image, the sensor 2 detects a displacement of the cyan image, and the sensor 3 detects a displacement of the magenta image.

To determine the compensation of the sub-scanning direction for each color, the average value of the amount of displacement with respect to the black image detected by the sensor 1, the sensor 2, and the sensor 3 is calculated. In order to compensate for the displacement, the timing of the XFGATE signal is changed by a time which determines the writing start time corresponding to the average value of the amount of displacement. For example, as for cyan, the average value of the amount of displacement is ((TBK1C1−To)+(TBK14C5−To) +(TBK9C3−To))/3, where (TBK1C1−To) is a displacement in Group 1 detected by the sensor 1, (TBK14C5−To) is a displacement in Group 3 detected by the sensor 2, and (TBK9C3−To) is a displacement in Group 2 detected by the sensor 3.

To determine the compensation of a writing start position of the main-scanning direction for each color, the timing of the XLGATE signal is changed by a time which determines the writing start time corresponding to the value of the amount of the displacement with respect to the Bk image detected by the sensor 1. The displacement of cyan is detected in Group 1. The displacement of magenta is detected in Group 2. The displacement of yellow is detected in Group 3. Regarding the detection of the amount of displacement, it is the same as example 1.

To determine the magnification compensation of the main-scanning direction for each color, the result detected by the sensor 1 and the result detected by the sensor 3 are used. As for cyan, a time TBK14 which is a time from detecting the pattern BK1 to detecting the pattern BK4 with the sensor 1, and a time TC12 which is a time from detecting the pattern C1 to detecting the pattern C2, are compared. The result is the difference TBK14−TC12. A time TBK912 which is a time from detecting the pattern BK9 to detecting the pattern BK12 with the sensor 3, and a time TC34 which is a time from detecting the pattern C3 to detecting the pattern C4, are compared. The result is the difference TBK912−TC34. Further, the two results are compared and the difference is (TBK912−TC34)−(TBK14-TC12). This difference is a magnification error of the cyan image with respect to the black image. In order to rectify this magnification error, the pixel clock frequency which determines image magnification is changed by only a part corresponding to the difference.

In addition, since the image position of the main-scanning direction also changes with a change of the pixel clock frequency, it is desirable to determine the amount of compensation of the image writing start position of the main-scanning direction in consideration of the change.

Figure 11:
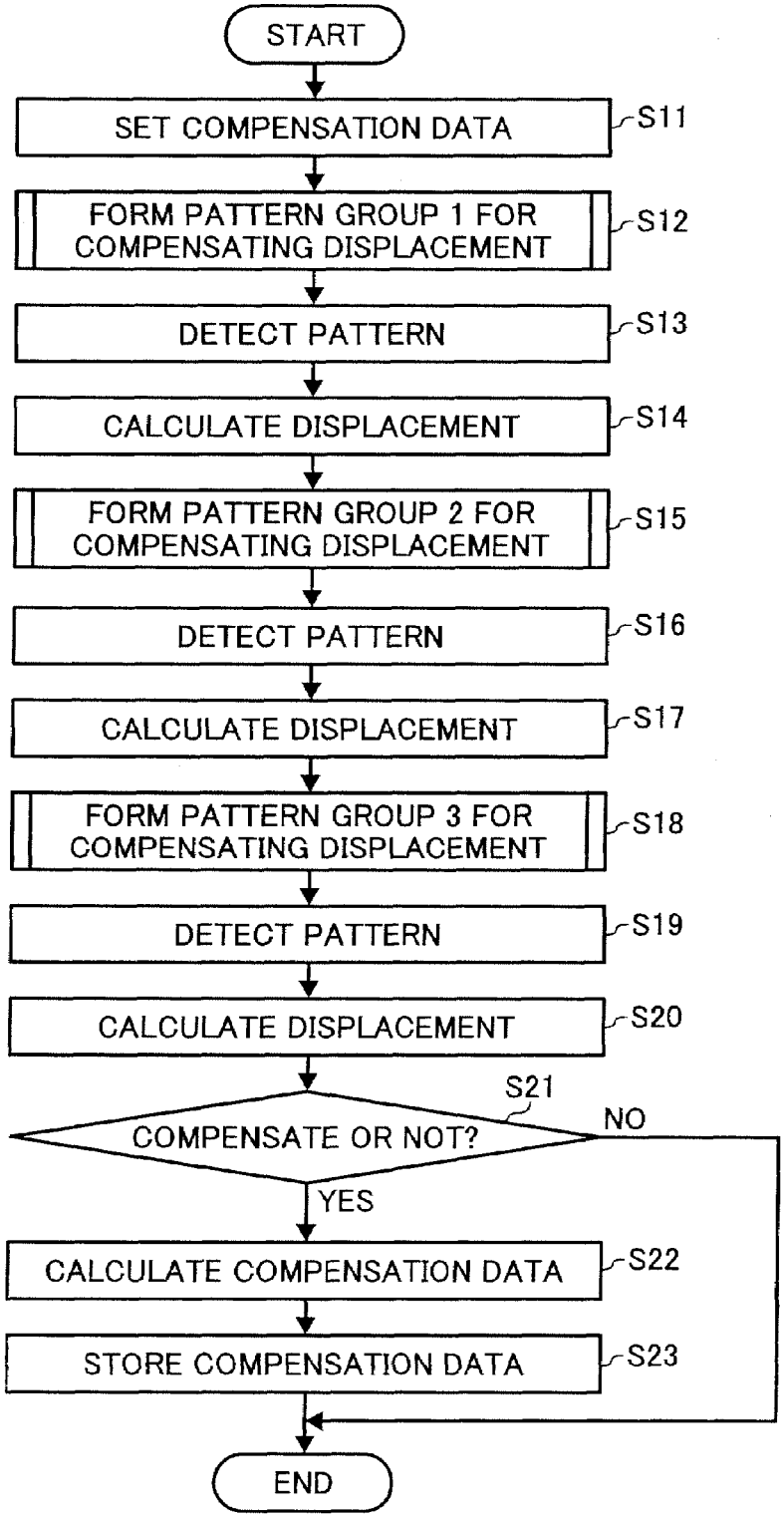
FIG. 11 is a flowchart for illustrating a flow of an operation of compensating for the displacement in FIG. 10.

FIG. 11 is a flowchart for illustrating a flow of an operation of compensating for the displacement in FIG. 10. The basic operation of the image displacement compensation flow concerning this example 2 is the same as example 1. However, example 2 differs in that the amount of compensation is calculated after detection of all groups (Groups 1, 2, and 3) is completed. That is, in Step S11, the printer controller 26 sends compensation data to each part of the image formation controller 100 like the above-mentioned step S1. In Step S12, the image formation controller 100 and the optical beam scanning device 15 are commanded, and the pattern for image displacement compensation of Group 1 shown in FIG. 10 is formed on the transfer belt 6. In Step S13, the sensor 1, the sensor 2, and the sensor 3 detect the pattern for image displacement compensation of Group 1 on the transfer belt 6. The output of each sensor is sent to the printer controller 26. In Step S14, the printer controller 26 calculates the displacements of Y, M, and C colors with respect to the reference color (Bk is the reference color in this case). Similarly, the printer controller 26 forms the pattern for the image displacement compensation of Group 2 on the transfer belt 6 in Step S15 with the image formation controller 100 and the optical beam scanning device 15. In Step S16, the sensor 1, the sensor 2, and the sensor 3 detect the patterns for image displacement compensation of Group 2. The displacement is calculated in Step S17. The printer controller 26 calculates the displacement by detection of the pattern for image displacement compensation of Group 3 by processing of Steps S18 through S20. Subsequent operation (Steps S21-S23) is the same as the operation (Steps S5-S7 of FIG. 9) of the first example.

As explained above, since each sensor detects the displacement with respect to the reference color for every group (Group 1, Group 2, and Group 3) according to the image forming apparatus and the image forming method of this example 2, a compensation accuracy can be raised, and the magnification error can be compensated besides the position compensation in the main-scan and the sub-scan directions.

EXAMPLE 3

Next, a third exemplary embodiment of the present invention is explained. In this example, the composition of the image forming apparatus, the optical beam scanning device, and the image formation controller are the same as the first example.

Figure 12:
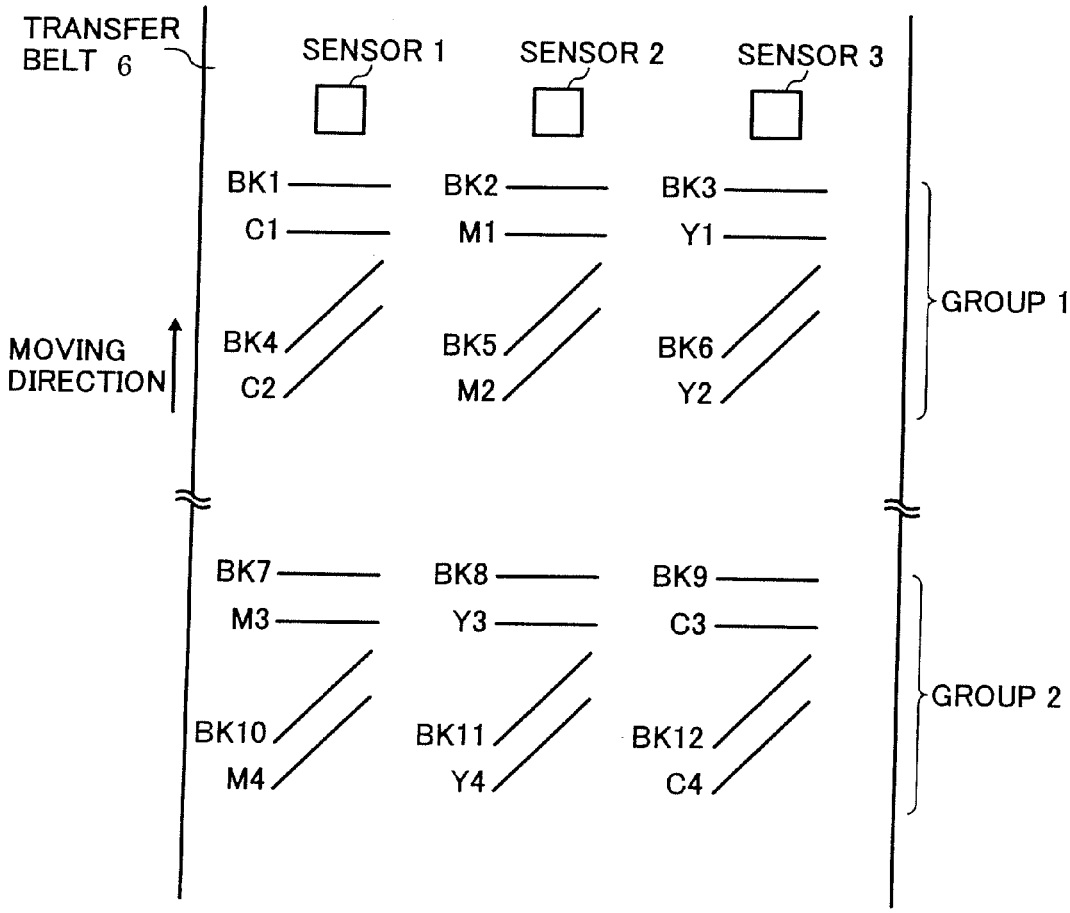
FIG. 12 is a top view illustrating a configuration of a pattern on a transfer belt for the compensation of image displacement in the third example of the image forming apparatus of FIG. 1.

FIG. 12 is a top view illustrating a configuration of a pattern on a transfer belt 6 for the compensation of image displacement in the third example of the image forming apparatus of FIG. 1. The detection of the amount of displacement using this pattern and the technique of the displacement compensation are the same as the second example. In FIG. 12, the patterns of two groups, called Group 1 and Group 2, are formed on the transfer belt 6.

In the part of Group 1 to be read by the sensor 1, Bk1 of a horizontal line pattern, C1 of a horizontal line pattern, Bk4 of a slanting line pattern, and C2 of a slanting line pattern are formed. As for the part of Group 1 to be read by the sensor 2, Bk2 of a horizontal line pattern, M1 of a horizontal line pattern, Bk5 of a slanting line pattern, and M2 of a slanting line pattern are formed. As for the part of Group 1 to be read by the sensor 3, Bk3 of a horizontal line pattern, Y1 of a horizontal line pattern, Bk6 of a slanting line pattern, and Y2 of a slanting line pattern are formed.

In the part of Group 2 to be read by the sensor 1, Bk7 of a horizontal line pattern, M3 of a horizontal line pattern, Bk10 of a slanting line pattern, and M4 of a slanting line pattern are formed. As for the part of Group 2 to be read by the sensor 2, Bk8 of a horizontal line pattern, Y3 of a horizontal line pattern, Bk11 of a slanting line pattern, and Y4 of a slanting line pattern are formed. As for the part of Group 2 to be read by the sensor 3, Bk9 of a horizontal line pattern, C3 of a horizontal line pattern, Bk12 of a slanting line pattern, and C4 of a slanting line pattern are formed.

In Group 1, the sensor 1 detects a displacement of the cyan image with respect to Bk as the reference color, the sensor 2 detects a displacement of the magenta image, and the sensor 3 detects a displacement of the yellow image. In Group 2, the sensor 1 detects a displacement of the magenta image, the sensor 2 detects a displacement of the yellow image, and the sensor 3 detects a displacement of the cyan image.

The compensation of the sub-scanning direction, and the image writing start position compensation of the main-scanning direction are the same as the second example. The magnification compensation of the main scan is carried out on each color based on the detection results of the two sensors. However, the different sensor detects each color in a different way than in the second example. In this third example, regarding cyan, it is the same as the second example. However, regarding magenta, the third example differs from the second example. In the third example, a time TBK25 which is a time from detecting the pattern BK2 to detecting the pattern BK5 with the sensor 2, and a time TM12 which is a time from detecting the pattern M1 to detecting the pattern M2, are compared. The result is the difference TBK25-TM12. A time TBK710 which is a time from detecting the pattern BK7 to detecting the pattern BK10 with the sensor 1, and a time TM34 which is a time from detecting the pattern M3 to detecting the pattern M4, are compared. The result is the difference TBK710−TM34. Further, the two results are compared and the difference is (TBK25−TM12)−(TBK710−TM34). This difference is a magnification error of the magenta image with respect to the black image. In order to rectify this magnification error, the pixel clock frequency, which determines image magnification, is changed by only a part corresponding to the difference. Regarding yellow, Group 1 detected by the sensor 3, and Group 2 detected by the sensor 2, are used.

Figure 13:
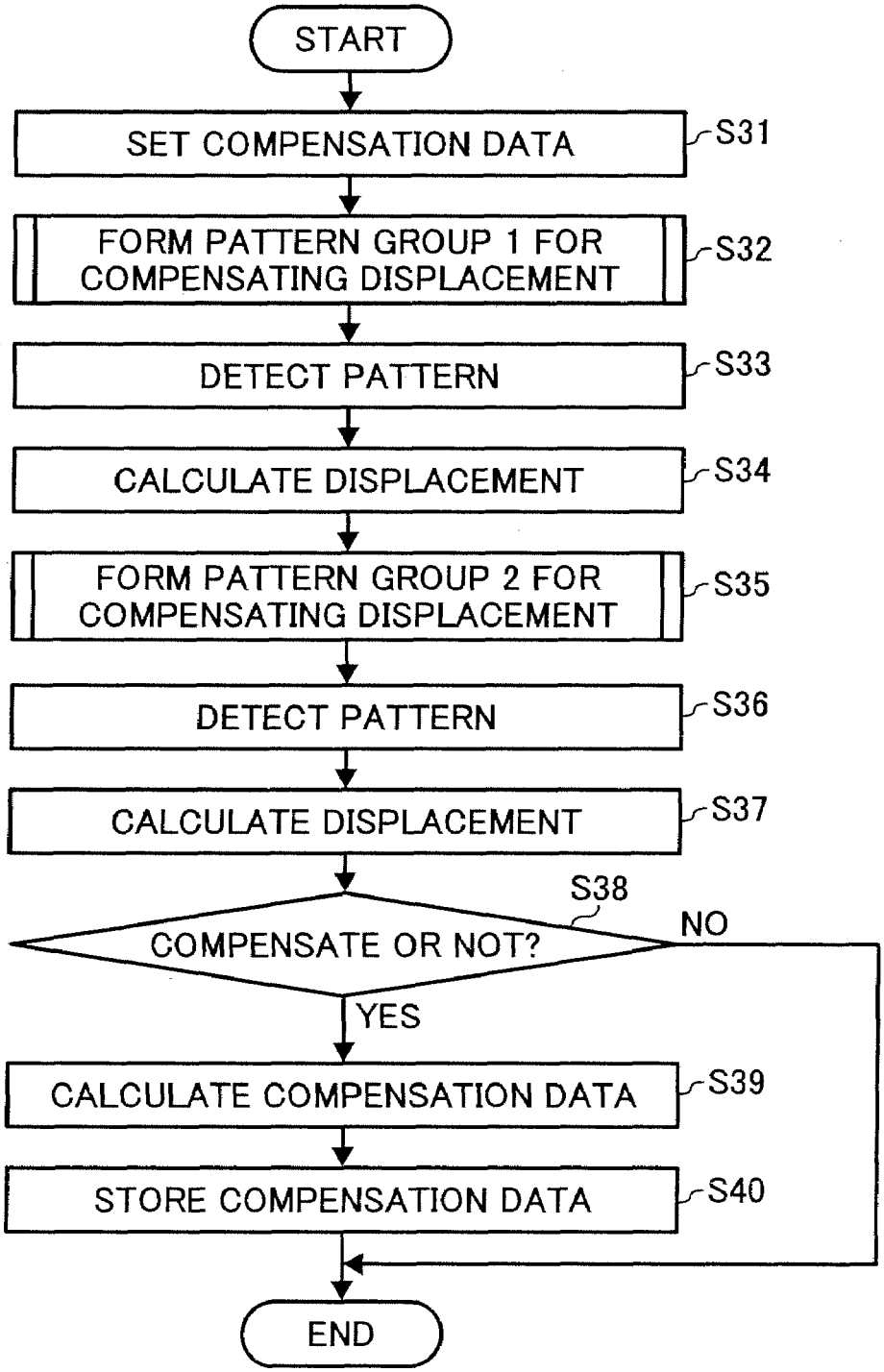
FIG. 13 is a flowchart for illustrating a flow of an operation of compensating for the displacement in FIG. 12.

FIG. 13 is a flowchart for illustrating a flow of an operation of compensating for the displacement in FIG. 12. The basic operation of the image displacement compensation flow concerning this example 3 is the same as the example 2. However, example 3 differs in that the number of groups is different from the example 2. That is, in Step S31, the printer controller 26 sends compensation data to each part of the image formation controller 100 like the above-mentioned step S11. In Step S32, the image formation controller 100 and the optical beam scanning device 15 are commanded, and the pattern for image displacement compensation of Group 1 shown in FIG. 12 is formed on the transfer belt 6. In Step S33, the sensor 1, the sensor 2, and the sensor 3 detect the pattern for image displacement compensation of Group 1 on the transfer belt 6. The output of each sensor is sent to the printer controller 26. In Step S34, the printer controller 26 calculates the displacements of Y, M, and C colors with respect to the reference color (Bk is the reference color in this case). Similarly, the printer controller 26 forms the pattern for the image displacement compensation of Group 2 on the transfer belt 6 in Step S35 with the image formation controller 100 and the optical beam scanning device 15. In Step S36, the sensor 1, sensor 2, and the sensor 3 detect the patterns for image displacement compensation of Group 2. The displacement is calculated in Step S37. Subsequent operation (Steps S38-S40) is the same as the operation (Steps S5-S7 of FIG. 9) of the first example.

As explained above, since each sensor detects the displacement with respect to the reference color for every group (Group 1 and Group 2) according to the image forming apparatus and the image forming method of this example 3, a compensation accuracy can be raised, and the magnification error can be compensated besides the position compensation in the main-scan and the sub-scan directions.

EXAMPLE 4

Next, a fourth exemplary embodiment of the present invention is explained. In this example, the composition of the image forming apparatus, the optical beam scanning device, and the image formation controller are the same as the first example.

Figure 14:
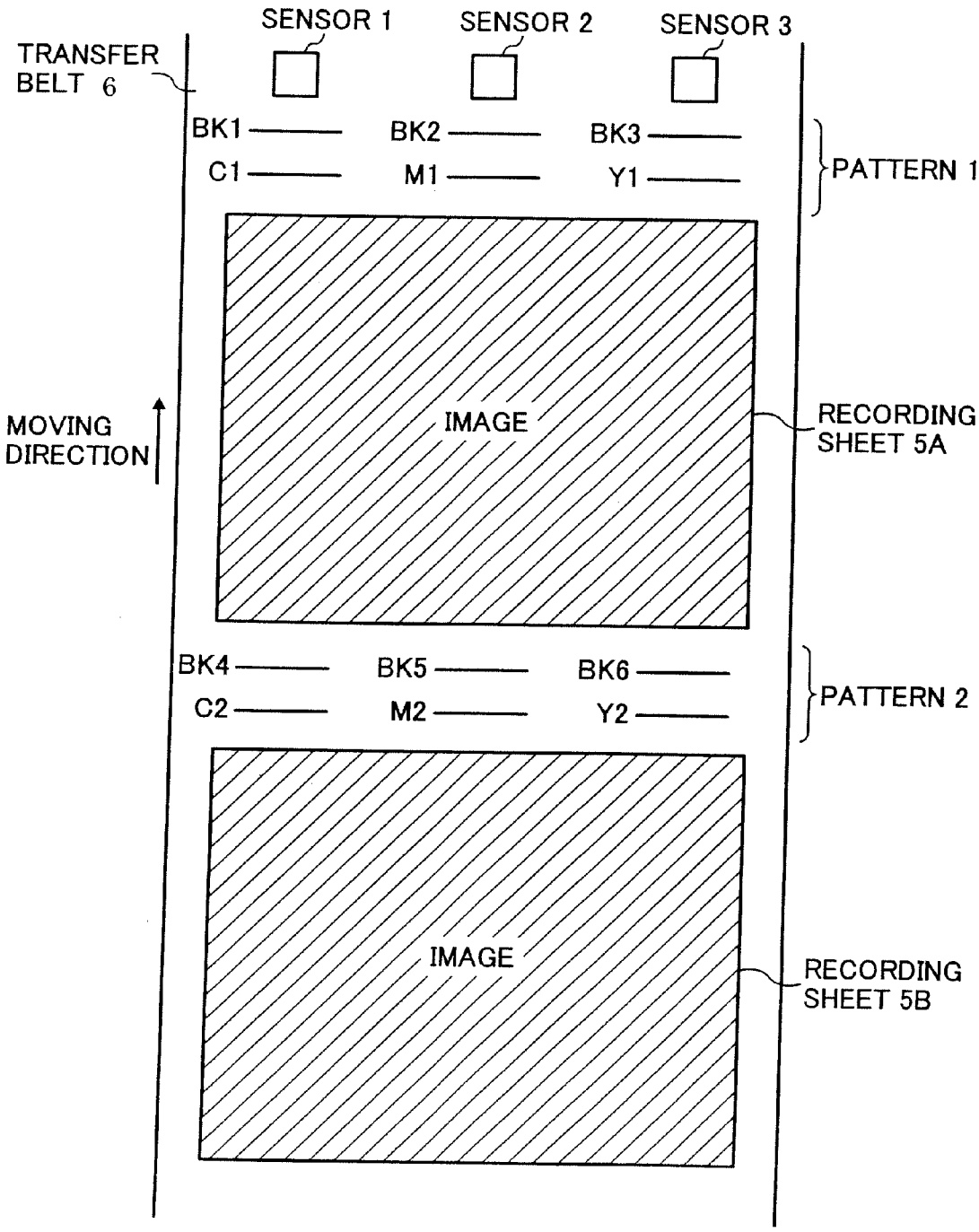
FIG. 14 is a top view illustrating a configuration of a pattern on a transfer belt for the compensation of image displacement in the fourth example of the image forming apparatus of FIG. 1.

FIG. 14 is a top view illustrating a configuration of a pattern on a transfer belt 6 for the compensation of image displacement in the fourth example of the image forming apparatus of FIG. 1. As shown in FIG. 14, the patterns for image displacement compensation are formed on the transfer belt 6 between the recording sheets (between pages) while a printing operation continues, and the image displacement compensation is performed with image formation operation. The detection of the amount of displacement using this pattern and the technique of the displacement compensation are the same as the first example. In FIG. 14, the pattern of Group 1 is formed forward of the recording sheet 5A on the transfer belt 6. The pattern of Group 2 is formed between the recording sheet 5A and the recording sheet 5B.

In the part of Pattern 1 to be read by the sensor 1, Bk1 of a horizontal line pattern, and C1 of a horizontal line pattern, are formed. As for the part of Pattern 1 to be read by the sensor 2, Bk2 of a horizontal line pattern, and M1 of a horizontal line pattern, are formed. As for the part of Pattern 1 to be read by the sensor 3, Bk3 of a horizontal line pattern, and Y1 of a horizontal line pattern, are formed.

In the part of Pattern 2 to be read by the sensor 1, Bk7 of a horizontal line pattern, and C2 of a horizontal line pattern, are formed. As for the part of Pattern 2 to be read by the sensor 2, Bk8 of a horizontal line pattern, and M2 of a horizontal line pattern, are formed. As for the part of Pattern 2 to be read by the sensor 3, Bk9 of a horizontal line pattern, and Y2 of a horizontal line pattern, are formed.

Figure 15:
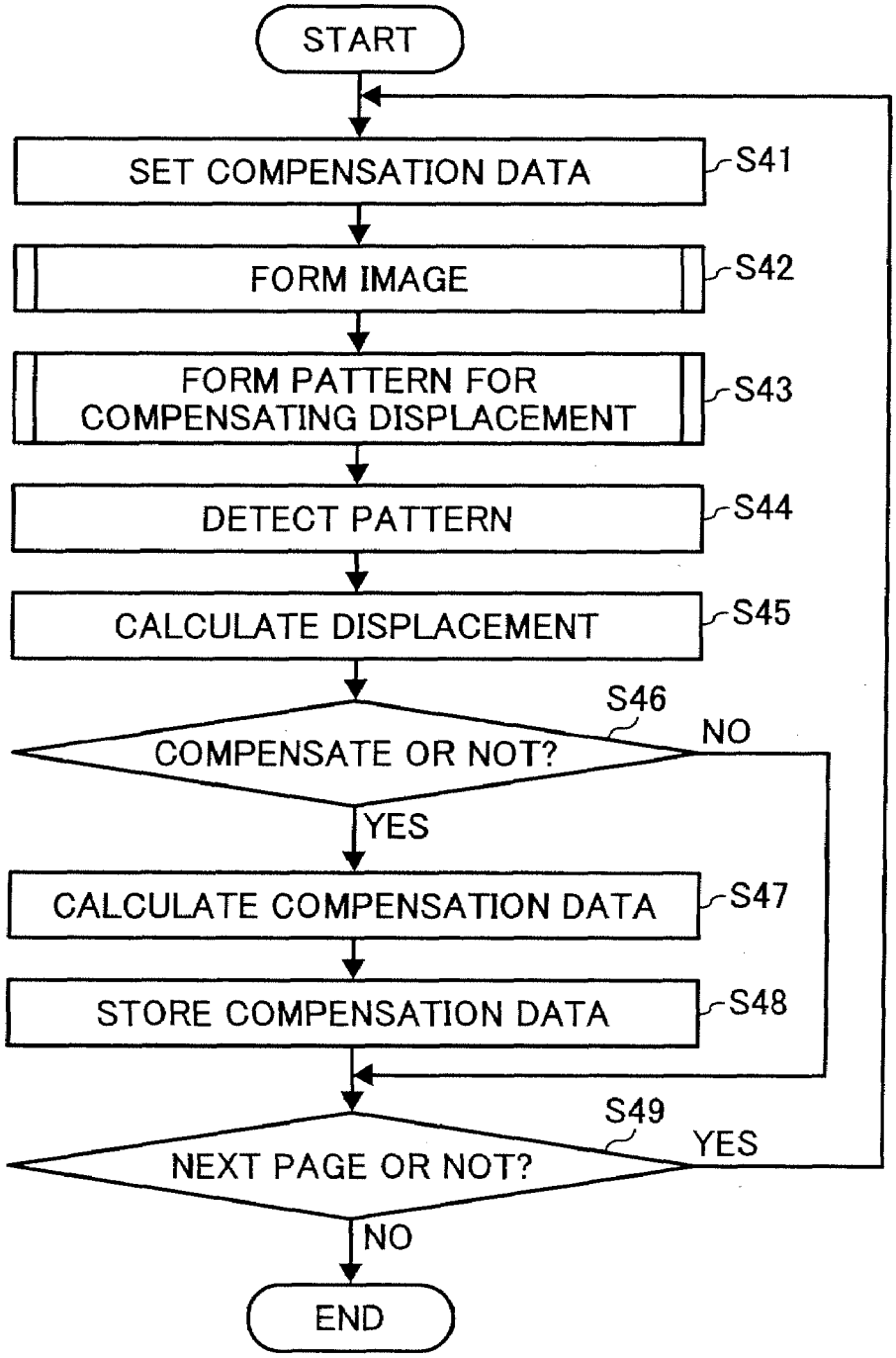
FIG. 15 is a flowchart for illustrating a flow of an operation of compensating for the displacement in FIG. 14.

FIG. 15 is a flowchart for illustrating a flow of an operation of compensating for the displacement in FIG. 14. In Step S41, the printer controller 26 sends compensation data to each part of the image formation controller 100 like the above-mentioned step S1. In Step S42, the image formation controller 100 and the optical beam scanning device 15 are commanded, and an image formation operation which forms an image on a recording sheet is started. After the image formation, in Step S43, the printer controller 26 sends commands to the image formation control 100 and the optical beam scanning device 15, and forms the pattern in the outside of the image domain where an image is not formed on a recording sheet for image displacement compensation shown in FIG. 14 on the transfer belt 6. In Step S44, the sensor 1, the sensor 2, and the sensor 3 detect the pattern of Group 1 for image displacement compensation on the transfer belt 6. The output of each sensor is sent to the printer controller 26. In Step S45, the printer controller 26 calculates the amount of displacement of the Y, M, and C colors with respect to the reference color (in this case, Bk is the reference color). The printer controller 26 determines whether a displacement compensation of each color is performed or not in Step S46. If the amount of displacement of each color is equal or larger than ½ of the resolution of the compensation, it is determined that the compensation is performed.

When it is determined that the displacement compensation is performed in Step S46, the printer controller 26 calculates the amount of compensation in the following step S47, and stores the value in the compensation data storage 27 in Step S48. The amounts of compensation as used in this step are the amount of compensation by the XFGATE signal which determines the image position of the sub-scanning direction.

After storing the value in the compensation data storage 27 in Step S48, or if it is determined that the displacement compensation is not performed in Step S46 (Step S46/NO), the printer controller 26 determines whether there is a next page or not in Step S49. When it is determined that there is a next page (Step S49/YES), the operation returns to Step S41. After that, processing of Steps S42-S49 is repeated. When it is determined that there is no following page in Step S49 (Step S49/NO), the operation is ended.

Although the compensation in the sub-scanning direction was explained in this example, the compensation of the main-scanning direction can be also attained by forming a slanted line. Moreover, although compensation data may be reflected in the image of the next page, the compensation data may not be determined in time depending on the distance between pages (time). In this case, the reflection of the compensation data is delayed.

In this example, as mentioned above, the patterns for image displacement compensation are formed on the transfer belt 6 between the recording sheets (between pages) during continuous printing, and the image displacement compensation is performed with image formation operation. Each sensor detects only the patterns of a reference color and other one color. Thus, the continuous print speed does not have to be reduced and the compensation control can be simplified.

EXAMPLE 5

Next, a fifth exemplary embodiment of the present invention is explained. In this example, the composition of the image forming apparatus, the optical beam scanning device, and the image formation controller are the same as the first example.

Figure 16:
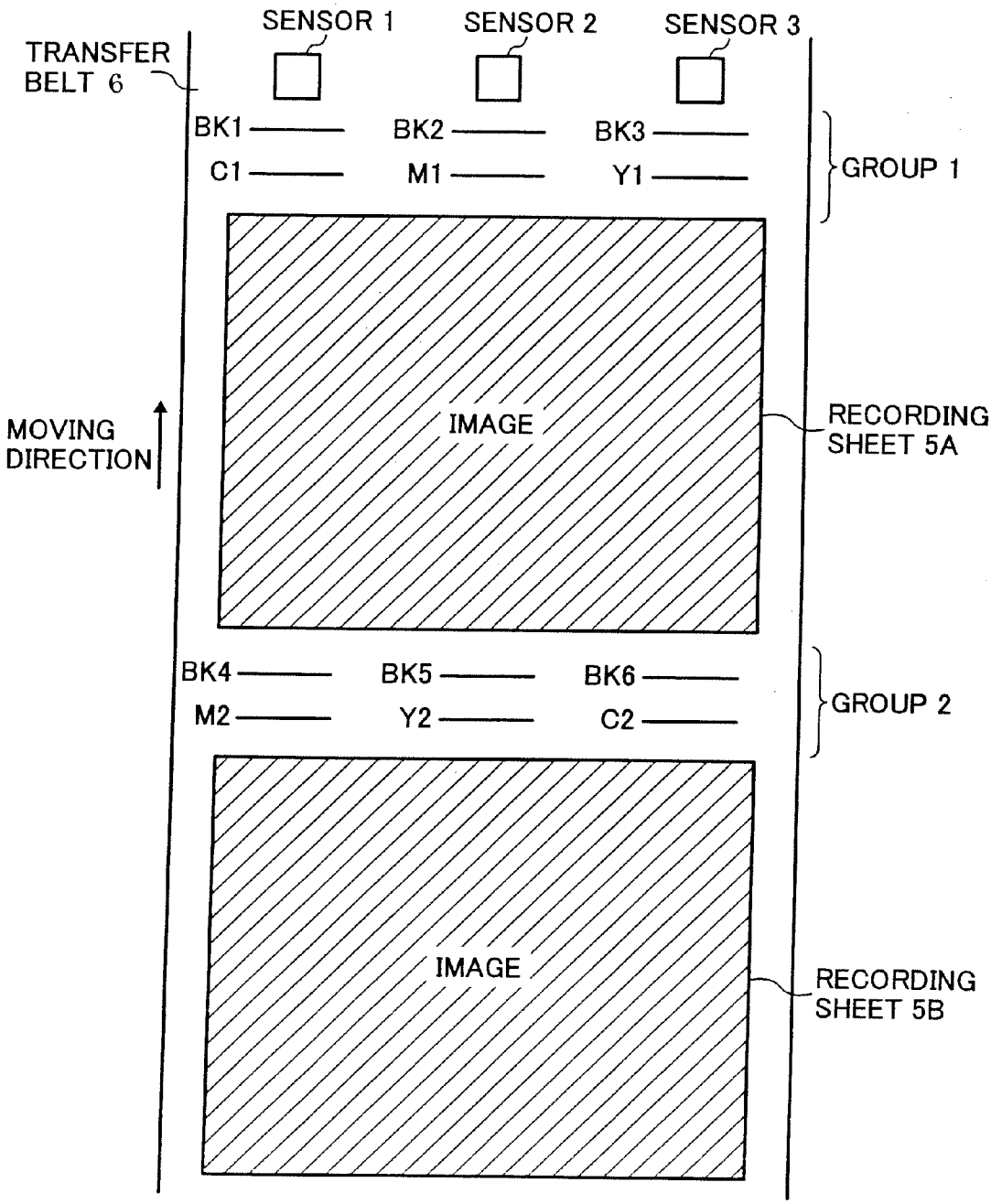
FIG. 16 is a top view illustrating a configuration of a pattern on a transfer belt for the compensation of image displacement in the fifth example of the image forming apparatus of FIG. 1.

FIG. 16 is a top view illustrating a configuration of a pattern on a transfer belt 6 for the compensation of image displacement in the fifth example of the image forming apparatus of FIG. 1. As shown in FIG. 16, the pattern of Group 1 is formed forward of the recording sheet 5A on the transfer belt 6. The pattern of Group 2 is formed between the recording sheet 5A and the recording sheet 5B similarly to the fourth example. However, this example is different from the fourth example in that the pattern position of each color is changed in Group 1 and Group 2, and a different sensor detects the patterns for image displacement compensation.

In the part of Group 1 read by the sensor 1, Bk1 of a horizontal line pattern, and C1 of a horizontal line pattern, are formed. As for the part of Group 1 read by the sensor 2, Bk2 of a horizontal line pattern, and M1 of a horizontal line pattern, are formed. As for the part of Group 1 read by the sensor 3, Bk3 of a horizontal line pattern, and Y1 of a horizontal line pattern, are formed.

In the part of Group 2 read by the sensor 1, Bk4 of a horizontal line pattern, and M2 of a horizontal line pattern, are formed. As for the part of Group 2 read by the sensor 2, Bk5 of a horizontal line pattern, and Y2 of a horizontal line pattern, are formed. As for the part of Group 2 read by the sensor 3, Bk6 of a horizontal line pattern, and C2 of a horizontal line pattern, are formed.

In Group 1, the sensor 1 detects a displacement of the cyan image with respect to Bk as the reference color, the sensor 2 detects a displacement of the magenta image, and the sensor 3 detects a displacement of the yellow image. In Group 2, the sensor 1 detects a displacement of the magenta image, the sensor 2 detects a displacement of the yellow image, and sensor 3 detects a displacement of the cyan image.

Figure 17:
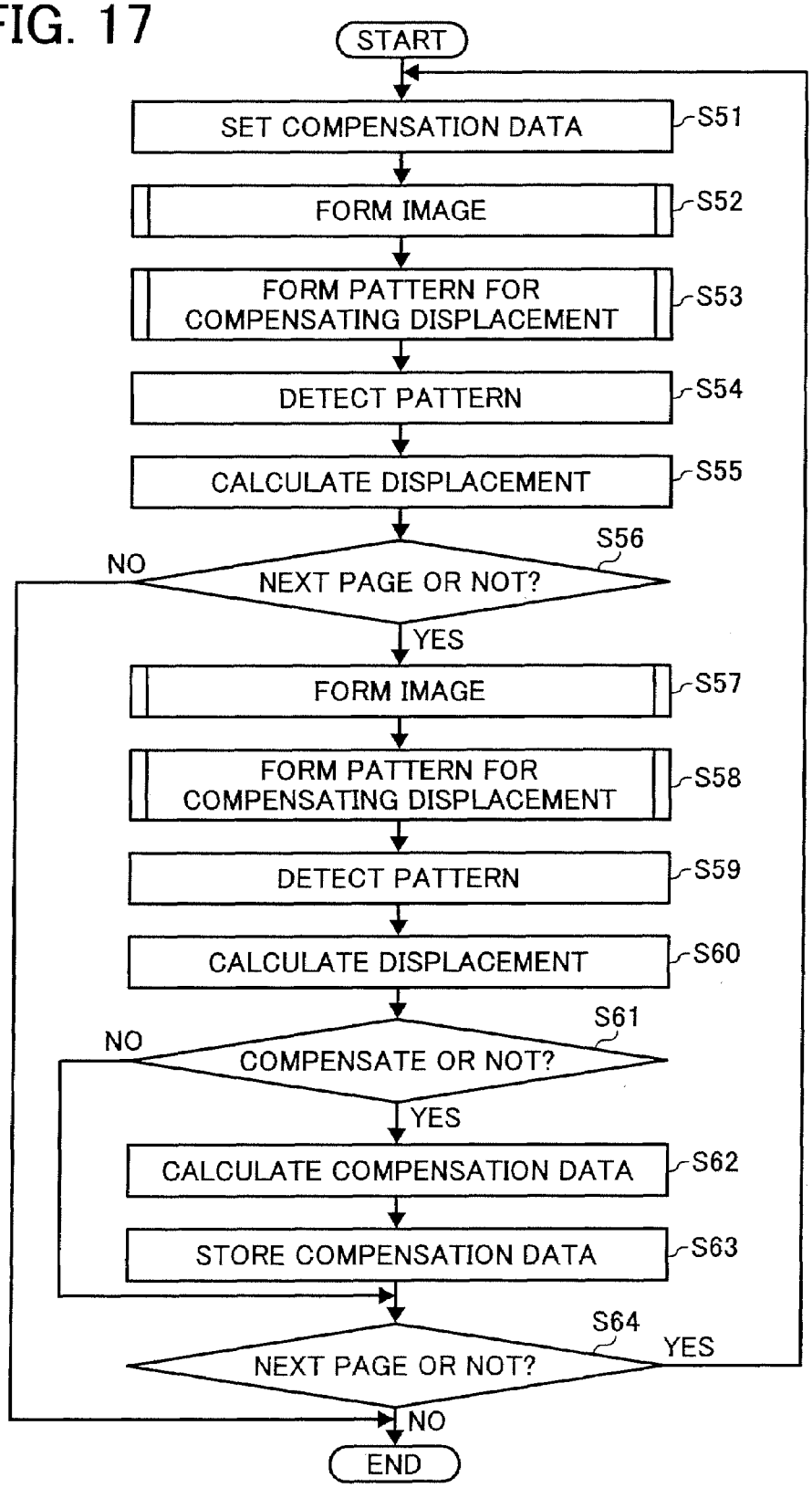
FIG. 17 is a flowchart for illustrating a flow of an operation of compensating for the displacement in FIG. 16.

FIG. 17 is a flowchart for illustrating a flow of an operation of compensating for the displacement in FIG. 16. The basic operation of the image displacement compensation flow concerning this example 5 is the same as the example 4. However, example 5 differs in that the amount of compensation is calculated after detection of two groups (Groups 1 and 2). That is, in Step S51, the printer controller 26 sends compensation data to each part of the image formation controller 100 like the above-mentioned step S1. In Step S52, the image formation controller 100 and the optical beam scanning device 15 are commanded, and an image formation operation which forms an image on a recording sheet is started. After the image formation, in Step S53, the printer controller 26 sends commands to the image formation control 100 and the optical beam scanning device 15, and forms the pattern of Group 1 in the outside of the image domain where an image is not formed on a recording sheet for image displacement compensation shown in FIG. 16 on the transfer belt 6. In Step S54, the sensor 1, the sensor 2, and the sensor 3 detect the pattern for image displacement compensation of Group 1 on the transfer belt 6. The output of each sensor is sent to the printer controller 26. In Step S55, the printer controller 26 calculates the displacements of Y, M, and C colors with respect to the reference color (Bk in this case). The printer controller 26 determines whether there is a next page or not in Step S56. When it is determined that there is a next page (Step S56/YES), regarding the next page, the image formation operation is carried out in Step S57 like Step S52. Similarly, the printer controller 26 forms the pattern for the image displacement compensation of Group 2 on the transfer belt 6 in Step S58 with the image formation controller 100 and the optical beam scanning device 15. In Step S59, the sensor 1, the sensor 2, and the sensor 3 detect the patterns for image displacement compensation of Group 2. The displacement of the colors is calculated in Step S60. The printer controller 26 determines whether a displacement compensation of each color is performed or not in Step S61. Subsequent operation (Steps S62-S64) is the same as the operation (Steps S46-S49 of FIG. 15) of the fourth example. In this example, the compensation data is calculated using an average value like the second example.

In this example, as mentioned above, the patterns for image displacement compensation are formed on the transfer belt 6 between the recording sheets (between pages) during continuous printing, and the image displacement compensation is performed with image formation operation. Each sensor detects the displacement with respect to other reference color. For this reason, the compensation accuracy can be raised.

EXAMPLE 6

Next, a sixth exemplary embodiment of the present invention is explained. In this example, the composition of the image forming apparatus, the optical beam scanning device, and the image formation controller are the same as the first example.

Figure 18:
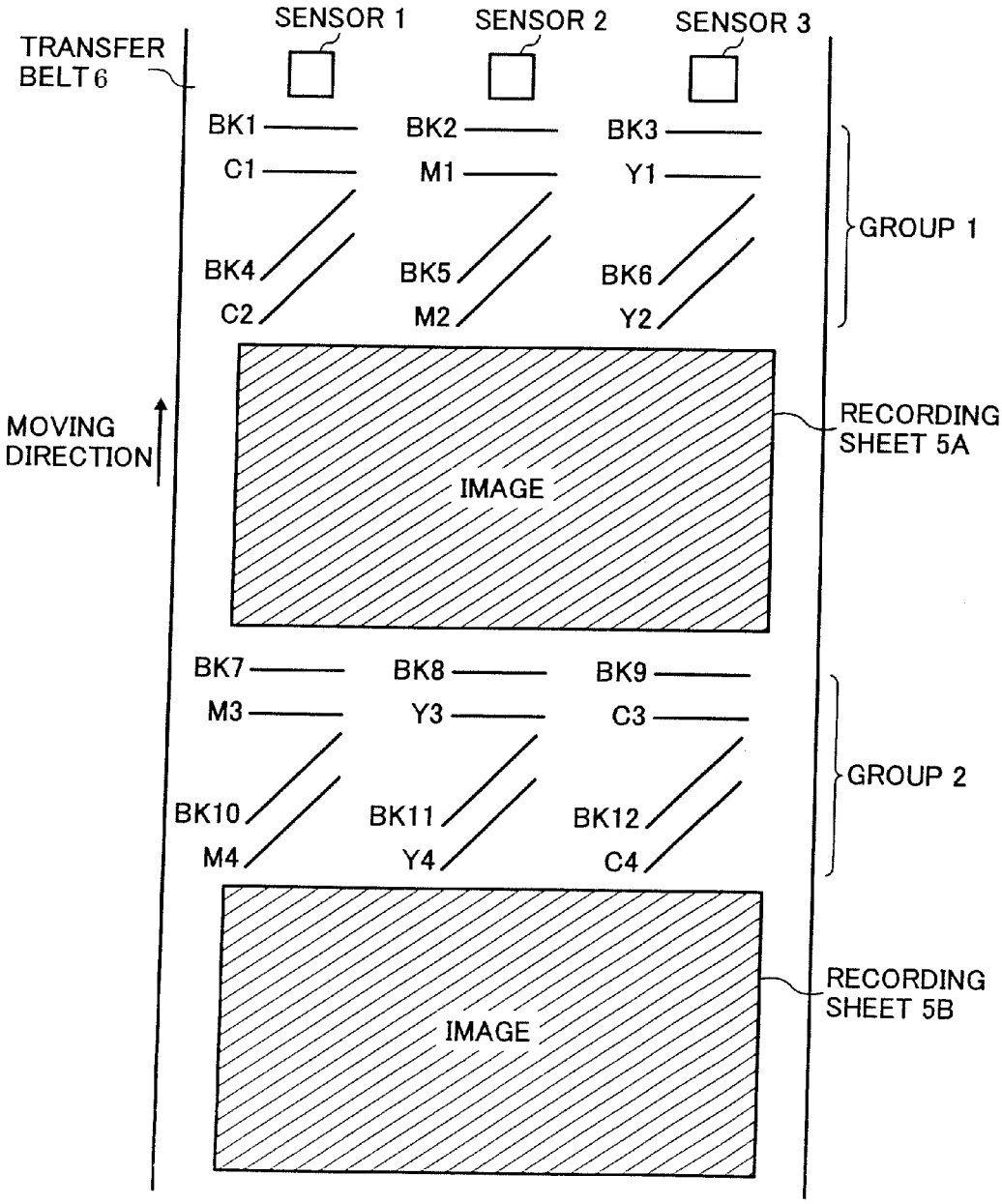
FIG. 18 is a top view illustrating a configuration of a pattern on a transfer belt for the compensation of image displacement in the sixth example of the image forming apparatus of FIG. 1

FIG. 18 is a top view illustrating a configuration of a pattern on a transfer belt 6 for the compensation of image displacement in the sixth example of the image forming apparatus of FIG. 1. As shown in FIG. 18, the pattern of Group 1 is formed forward of the recording sheet 5A on the transfer belt 6. The pattern of Group 2 is formed between the recording sheet 5A and the recording sheet 5B similarly to the fifth example. However, this example is different from the fifth example in that a slanting line pattern is added to Group 1 and Group 2, and the compensation of the writing start position in the main-scanning direction and the magnification compensation in the main-scanning direction can be carried out.

In the part of Group 1 read by the sensor 1, Bk1 of a horizontal line pattern, C1 of a horizontal line pattern, Bk4 of a slanting line pattern, and C2 of a slanting line pattern are formed. As for the part of Group 1 read by the sensor 2, Bk2 of a horizontal line pattern, M1 of a horizontal line pattern, Bk5 of a slanting line pattern, and M2 of a slanting line pattern are formed. As for the part of Group 1 read by the sensor 3, Bk3 of a horizontal line pattern, Y1 of a horizontal line pattern, Bk6 of a slanting line pattern, and Y2 of a slanting line pattern are formed.

In the part of Group 2 read by the sensor 1, Bk7 of a horizontal line pattern, M3 of a horizontal line pattern, Bk10 of a slanting line pattern, and M4 of a slanting line pattern are formed. As for the part of Group 2 read by the sensor 2, Bk8 of a horizontal line pattern, Y3 of a horizontal line pattern, Bk11 of a slanting line pattern, and Y4 of a slanting line pattern are formed. As for the part of Group 2 read by the sensor 3, Bk9 of a horizontal line pattern, C3 of a horizontal line pattern, Bk12 of a slanting line pattern, and C4 of a slanting line pattern are formed.

In Group 1, the sensor 1 detects a displacement of the cyan image with respect to Bk as the reference color, the sensor 2 detects a displacement of the magenta image, and the sensor 3 detects a displacement of the yellow image. In Group 2, the sensor 1 detects a displacement of the magenta image, the sensor 2 detects a displacement of the yellow image, and the sensor 3 detects a displacement of the cyan image.

The image displacement compensation method using such a pattern for image displacement compensation is almost the same as the above-mentioned example 3. The image displacement compensation flow of this example is almost the same as the above-mentioned example 5.

In this example, as mentioned above, the patterns for image displacement compensation are formed on the transfer belt 6 between the recording sheets (between pages) during continuous printing, and the image displacement compensation is performed with image formation operation. The displacement compensation is carried out using the slanting line pattern. For this reason, the compensation accuracy can be raised, and the magnification error can be compensated for besides the position compensation in the main-scan and the sub-scan directions.

As mentioned above, although exemplary embodiments of the present invention were explained, this invention is not limited to the publication of each above-mentioned example, and various modifications are possible without deviating from the range of the disclosure.

This invention is not limited to the above-mentioned examples. It is clear that the form of each of the above-mentioned examples may be suitably changed within the limits of this invention. Also, the number of components, a position, form, etc. are not limited to the form of each of the above-mentioned examples, when carrying out this invention, they may have a suitable number, a position, form, etc.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JPAP2006-075472 filed on Mar. 17, 2006 in the Japan Patent Office, the entire contents of which are incorporated by reference herein.

What is claimed:

1. An image forming apparatus, comprising:

a compensation pattern forming device configured to form a predetermined compensation pattern to compensate image displacement in each of a plurality of key colors;

a plurality of detectors including at least three detectors each configured to detect two of the key colors, including a reference key color and a different key color from the other detectors, in the predetermined compensation pattern; and a compensating device configured to compensate the image displacement of the two of the key colors detected by each of the detectors.

2. The image forming apparatus of claim 1, wherein the predetermined compensation pattern includes a plurality of groups, each of the detectors is configured to detect a first different key color in a first one of the groups of the predetermined compensation pattern and a second different key color in a second one of the groups, and the first different key color and the second different key color are same colors of the key colors for each of the detectors.

3. The image forming apparatus of claim 1, wherein the predetermined compensation pattern includes a plurality of groups, each of the detectors is configured to detect a first different key color in a first one of the groups of the predetermined compensation pattern and a second different key color in a second one of the groups, and the first different key color and the second different key color are different colors of the key colors for each of the detectors.

4. The image forming apparatus of claim 1, wherein the compensation pattern forming device is configured to form the predetermined compensation pattern in any predetermined position for compensating the image displacement.

5. The image forming apparatus of claim 4, wherein the compensation pattern forming device is configured to form the predetermined compensation pattern in a different position every time the displacement between the two of the key colors is detected.

6. The image forming apparatus of claim 1, further comprising:

an electrostatic image forming device configured to form an image on a recording medium.

7. The image forming apparatus of claim 6, wherein the compensation pattern forming device is configured to form the predetermined compensation pattern between recording media.

8. The image forming apparatus of claim 7, wherein the compensation pattern forming device is configured to form the predetermined compensation pattern between the recording media on a transfer member of the electrostatic image forming device.

9. A method for image forming, comprising:

forming a predetermined compensation pattern to compensate image displacement in each of a plurality of key colors;

detecting the key colors in the predetermined compensation pattern by at least three detectors, and each of the detectors is configured to detect two of the key colors including a reference key color and a different key color from the other detectors; and compensating the image displacement of the two of the key colors detected by each of the detectors.

10. The image forming method of claim 9, wherein the forming includes forming the predetermined compensation pattern to include a plurality of groups, and the detecting includes detecting via each of the detectors a first different key color in a first one of the groups of the predetermined compensation pattern and a second different key color in a second one of the groups, and the first different key color and the second different key color are different colors of the key colors for each of the detectors.

11. The image forming method of claim 9, wherein the forming includes forming the predetermined compensation pattern to include a plurality of groups, and the detecting includes detecting via each of the detectors a first different key color in a first one of the groups of the predetermined compensation pattern and a second different key color in a second one of the groups, and the first different key color and the second different key color are same colors of the key colors for each of the detectors.

12. The image forming method of claim 9, further comprising:

forming an image on a recording medium using an electrostatic image forming device.

13. The image forming method of claim 12,wherein the predetermined compensation pattern for compensation of the image displacement is formed between recording media.

14. The image forming method of claim 13, wherein the predetermined compensation pattern for compensation of the image displacement is formed between the recording media on a transfer member of the electrostatic image forming device.

15. The image forming method of claim 9, wherein the predetermined compensation pattern is formed in any predetermined position for compensating the image displacement.

16. The image forming method of claim 15, wherein the predetermined compensation pattern for compensation of the image displacement is formed in a different position every time the displacement between the two of the key colors is detected.

17. An image forming apparatus, comprising:

means for forming a predetermined compensation pattern to compensate image displacement in each of a plurality of key colors;

means for detecting the key colors including at least three detectors each configured to detect two of the key colors, including a reference key color and a different key color from the other detectors, in the predetermined compensation pattern; and means for compensating for the image displacement of the two of the key colors detected by each of the detectors.

18. The image forming apparatus of claim 17, wherein the predetermined compensation pattern includes a plurality of groups, each of the detectors is configured to detect a first different key color in a first one of the groups of the predetermined compensation pattern and a second different key color in a second one of the groups, and the first different key color and the second different key color are same colors of the key colors for each of the detectors.

19. The image forming apparatus of claim 17, wherein the predetermined compensation pattern includes a plurality of groups, each of the detectors is configured to detect a first different key color in a first one of the groups of the predetermined compensation pattern and a second different key color in a second one of the groups, and the first different key color and the second different key color are different colors of the key colors for each of the detectors.

* * * * *